US009166306B2

(12) United States Patent
Montena et al.

(10) Patent No.: US 9,166,306 B2
(45) Date of Patent: Oct. 20, 2015

(54) METHOD OF TERMINATING A COAXIAL CABLE

(75) Inventors: Noah Montena, Syracuse, NY (US); Shawn Chawgo, Cicero, NY (US)

(73) Assignee: John Mezzalingua Associates, LLC, Liverpool, NY (US)

( * ) Notice: Subject to any disclaimer, the term of this patent is extended or adjusted under 35 U.S.C. 154(b) by 582 days.

(21) Appl. No.: 12/753,742

(22) Filed: Apr. 2, 2010

(65) Prior Publication Data

US 2011/0239455 A1 Oct. 6, 2011

(51) Int. Cl.

| | |
|---|---|
| ***H01R 43/00*** | (2006.01) |
| ***H01R 9/05*** | (2006.01) |
| ***H01R 24/56*** | (2011.01) |

(52) U.S. Cl.

CPC ..... *H01R 9/0524* (2013.01); *H01R 24/56* (2013.01); *Y10T 29/49123* (2015.01); *Y10T 29/49185* (2015.01)

(58) Field of Classification Search

CPC ..... H01R 24/56; H01R 9/0524; Y10T 29/49123; Y10T 29/49185

USPC ..... 29/857, 861, 863; 439/20, 21, 584; 174/28

See application file for complete search history.

(56) References Cited

U.S. PATENT DOCUMENTS

| | | | |
|---|---|---|---|
| 2,258,737 | A | 10/1941 | Browne |
| 2,785,384 | A | 3/1957 | Wickesser |
| 3,022,482 | A | 2/1962 | Waterfield et al. |
| 3,076,169 | A | 1/1963 | Blaisdell |
| 3,184,706 | A | 5/1965 | Atkins |
| 3,221,290 | A | 11/1965 | Stark et al. |
| 3,275,913 | A | 9/1966 | Blanchard et al. |
| 3,297,979 | A | 1/1967 | O'Keefe et al. |

(Continued)

FOREIGN PATENT DOCUMENTS

| | | |
|---|---|---|
| DE | 29800824 | 4/1998 |
| EP | 0010567 | 5/1980 |

(Continued)

OTHER PUBLICATIONS

Chawgo, S., et al., Coaxial Cable Compression Connectors, U.S. Appl. No. 13/093,937, filed Apr. 26, 2011.

(Continued)

*Primary Examiner* — Peter DungBa Vo
*Assistant Examiner* — Jeffrey T Carley
(74) *Attorney, Agent, or Firm* — Barclay Damon, LLP

(57) ABSTRACT

Passive intermodulation (PIM) and impedance management in coaxial cable terminations. In one example embodiment, a method for terminating a coaxial cable is provided. The coaxial cable includes an inner conductor, an insulating layer, an outer conductor, and a jacket. First, a diameter of the outer conductor that surrounds a cored-out section of the insulating layer is increased so as to create an increased-diameter cylindrical section of the outer conductor. Next, an internal connector structure is inserted into the cored-out section so as to be surrounded by the increased-diameter cylindrical section. Finally, an external connector structure is clamped around the increased-diameter cylindrical section so as to radially compress the increased-diameter cylindrical section between the external connector structure and the internal connector structure, and via a single action, a contact force between the inner conductor and a conductive pin is increased.

11 Claims, 22 Drawing Sheets

(56) References Cited

U.S. PATENT DOCUMENTS

| | | | | |
|---|---|---|---|---|
| 3,321,732 | A | | 5/1967 | Forney, Jr. |
| 3,355,698 | A | | 11/1967 | Keller |
| 3,372,364 | A | | 3/1968 | O'Keefe et al. |
| 3,406,373 | A | | 10/1968 | Forney, Jr. |
| 3,498,647 | A | | 3/1970 | Schroder |
| 3,539,976 | A | | 11/1970 | Reynolds |
| 3,581,269 | A | | 5/1971 | Frey |
| 3,629,792 | A | | 12/1971 | Dorrell |
| 3,671,922 | A | | 6/1972 | Zerlin et al. |
| 3,671,926 | A | | 6/1972 | Nepovim |
| 3,678,446 | A | | 7/1972 | Siebelist |
| 3,686,623 | A | | 8/1972 | Nijman |
| 3,710,005 | A | | 1/1973 | French |
| 3,744,011 | A | | 7/1973 | Blanchenot |
| 3,757,279 | A | | 9/1973 | Winston |
| 3,764,959 | A | | 10/1973 | Toma et al. |
| 3,845,453 | A | | 10/1974 | Hemmer |
| 3,879,102 | A | | 4/1975 | Horak |
| 3,915,539 | A | | 10/1975 | Collins |
| 3,936,132 | A | | 2/1976 | Hutter |
| 3,963,321 | A | | 6/1976 | Burger et al. |
| 3,985,418 | A | | 10/1976 | Spinner |
| 4,035,054 | A | | 7/1977 | Lattanzi |
| 4,046,451 | A | | 9/1977 | Juds et al. |
| 4,047,291 | A | | 9/1977 | Spinner |
| 4,053,200 | A | | 10/1977 | Pugner |
| 4,059,330 | A | | 11/1977 | Shirey |
| 4,126,372 | A | | 11/1978 | Hashimoto et al. |
| 4,156,554 | A | | 5/1979 | Aujla |
| 4,168,921 | A | | 9/1979 | Blanchard |
| 4,173,385 | A | | 11/1979 | Fenn et al. |
| 4,227,765 | A | | 10/1980 | Neumann et al. |
| 4,280,749 | A | | 7/1981 | Hemmer |
| 4,305,638 | A | | 12/1981 | Hutter |
| 4,339,166 | A | | 7/1982 | Dayton |
| 4,346,958 | A | | 8/1982 | Blanchard |
| 4,354,721 | A | | 10/1982 | Luzzi |
| 4,373,767 | A | | 2/1983 | Cairns |
| 4,400,050 | A | | 8/1983 | Hayward |
| 4,408,821 | A | | 10/1983 | Forney, Jr. |
| 4,408,822 | A | | 10/1983 | Nikitas |
| 4,421,377 | A | | 12/1983 | Spinner |
| 4,444,453 | A | | 4/1984 | Kirby et al. |
| 4,456,324 | A | | 6/1984 | Staeger |
| 4,484,792 | A | | 11/1984 | Tengler et al. |
| 4,491,685 | A | | 1/1985 | Drew et al. |
| 4,533,191 | A | | 8/1985 | Blackwood |
| 4,545,637 | A | | 10/1985 | Bosshard et al. |
| 4,557,546 | A | | 12/1985 | Dreyer |
| 4,575,274 | A | | 3/1986 | Hayward |
| 4,583,811 | A | | 4/1986 | McMills |
| 4,596,435 | A | | 6/1986 | Bickford |
| 4,600,263 | A | | 7/1986 | DeChamp et al. |
| 4,614,390 | A | | 9/1986 | Baker |
| 4,645,281 | A | | 2/1987 | Burger |
| 4,650,228 | A | | 3/1987 | McMills et al. |
| 4,655,159 | A | | 4/1987 | McMills |
| 4,660,921 | A | | 4/1987 | Hauver |
| 4,668,043 | A | | 5/1987 | Saba et al. |
| 4,674,818 | A | | 6/1987 | McMills et al. |
| 4,676,577 | A | | 6/1987 | Szegda |
| 4,684,201 | A | | 8/1987 | Hutter |
| 4,691,976 | A | | 9/1987 | Cowen |
| 4,738,009 | A | | 4/1988 | Down et al. |
| 4,746,305 | A | | 5/1988 | Nomura |
| 4,747,786 | A | | 5/1988 | Hayashi et al. |
| 4,755,152 | A | | 7/1988 | Elliot et al. |
| 4,789,355 | A | | 12/1988 | Lee |
| 4,804,338 | A | | 2/1989 | Dibble et al. |
| 4,806,116 | A | | 2/1989 | Ackerman |
| 4,813,886 | A | | 3/1989 | Roos et al. |
| 4,824,400 | A | | 4/1989 | Spinner |
| 4,824,401 | A | | 4/1989 | Spinner |
| 4,834,675 | A | | 5/1989 | Samchisen |
| 4,854,893 | A | | 8/1989 | Morris |
| 4,857,014 | A | | 8/1989 | Alf et al. |
| 4,869,679 | A | | 9/1989 | Szegda |
| 4,892,275 | A | | 1/1990 | Szegda |
| 4,902,246 | A | | 2/1990 | Samchisen |
| 4,906,207 | A | | 3/1990 | Banning et al. |
| 4,917,631 | A | | 4/1990 | Souders et al. |
| 4,923,412 | A | | 5/1990 | Morris |
| 4,925,403 | A | | 5/1990 | Zorzy |
| 4,929,188 | A | | 5/1990 | Lionetto et al. |
| 4,973,265 | A | | 11/1990 | Heeren |
| 4,990,104 | A | | 2/1991 | Schieferly |
| 4,990,105 | A | | 2/1991 | Karlovich |
| 4,990,106 | A | | 2/1991 | Szegda |
| 5,002,503 | A | | 3/1991 | Campbell et al. |
| 5,011,432 | A | | 4/1991 | Sucht et al. |
| 5,021,010 | A | | 6/1991 | Wright |
| 5,024,606 | A | | 6/1991 | Ming-Hwa |
| 5,037,328 | A | | 8/1991 | Karlovich |
| 5,062,804 | A | | 11/1991 | Jamet et al. |
| 5,066,248 | A | | 11/1991 | Gaver, Jr. et al. |
| 5,073,129 | A | | 12/1991 | Szegda |
| 5,083,943 | A | | 1/1992 | Tarrant |
| 5,127,853 | A | | 7/1992 | McMills et al. |
| 5,131,862 | A | | 7/1992 | Gershfeld |
| 5,137,471 | A | | 8/1992 | Verespej et al. |
| 5,141,451 | A | | 8/1992 | Down |
| 5,154,636 | A | * | 10/1992 | Vaccaro et al. ..... 439/583 |
| 5,166,477 | A | | 11/1992 | Perin, Jr. et al. |
| 5,181,161 | A | | 1/1993 | Hirose et al. |
| 5,195,906 | A | | 3/1993 | Szegda |
| 5,205,761 | A | | 4/1993 | Nilsson |
| 5,207,602 | A | | 5/1993 | McMills et al. |
| 5,217,391 | A | | 6/1993 | Fisher, Jr. |
| 5,217,393 | A | | 6/1993 | Del Negro et al. |
| 5,269,701 | A | | 12/1993 | Leibfried, Jr. |
| 5,283,853 | A | | 2/1994 | Szegda |
| 5,284,449 | A | | 2/1994 | Vaccaro |
| 5,295,864 | A | | 3/1994 | Birch et al. |
| 5,316,494 | A | | 5/1994 | Flanagan et al. |
| 5,322,454 | A | | 6/1994 | Thommen |
| 5,338,225 | A | | 8/1994 | Jacobsen et al. |
| 5,340,332 | A | | 8/1994 | Nakajima et al. |
| 5,342,218 | A | | 8/1994 | McMills et al. |
| 5,352,134 | A | | 10/1994 | Jacobsen et al. |
| 5,354,217 | A | | 10/1994 | Gabel et al. |
| 5,371,819 | A | | 12/1994 | Szegda |
| 5,371,821 | A | | 12/1994 | Szegda |
| 5,371,827 | A | | 12/1994 | Szegda |
| 5,393,244 | A | | 2/1995 | Szegda |
| 5,431,583 | A | | 7/1995 | Szegda |
| 5,435,745 | A | | 7/1995 | Booth |
| 5,444,810 | A | | 8/1995 | Szegda |
| 5,455,548 | A | | 10/1995 | Grandchamp et al. |
| 5,456,611 | A | | 10/1995 | Henry et al. |
| 5,456,614 | A | | 10/1995 | Szegda |
| 5,466,173 | A | | 11/1995 | Down |
| 5,470,257 | A | | 11/1995 | Szegda |
| 5,494,454 | A | | 2/1996 | Johnsen |
| 5,501,616 | A | | 3/1996 | Holliday |
| 5,518,420 | A | | 5/1996 | Pitschi |
| 5,525,076 | A | | 6/1996 | Down |
| 5,542,861 | A | | 8/1996 | Anhalt et al. |
| 5,548,088 | A | | 8/1996 | Gray et al. |
| 5,561,900 | A | | 10/1996 | Hosier, Sr. |
| 5,571,028 | A | | 11/1996 | Szegda |
| 5,586,910 | A | | 12/1996 | Del Negro et al. |
| 5,598,132 | A | | 1/1997 | Stabile |
| 5,607,325 | A | | 3/1997 | Toma |
| 5,619,015 | A | | 4/1997 | Kirma |
| 5,651,698 | A | | 7/1997 | Locati et al. |
| 5,651,699 | A | | 7/1997 | Holliday |
| 5,662,489 | A | | 9/1997 | Stirling |
| 5,667,405 | A | | 9/1997 | Holliday |
| 5,785,554 | A | | 7/1998 | Ohshiro |
| 5,795,188 | A | | 8/1998 | Harwath |
| 5,863,220 | A | | 1/1999 | Holliday |
| 5,938,474 | A | | 8/1999 | Nelson |
| 5,957,724 | A | | 9/1999 | Lester |
| 5,975,951 | A | | 11/1999 | Burris et al. |

(56) References Cited

U.S. PATENT DOCUMENTS

| | | | |
|---|---|---|---|
| 5,984,723 | A | 11/1999 | Wild |
| 5,993,254 | A | 11/1999 | Pitschi et al. |
| 5,997,350 | A | 12/1999 | Burris et al. |
| 6,019,636 | A | 2/2000 | Langham |
| 6,027,373 | A | 2/2000 | Gray et al. |
| 6,032,358 | A | 3/2000 | Wild |
| 6,034,325 | A | 3/2000 | Nattel et al. |
| 6,036,237 | A | 3/2000 | Sweeney |
| RE36,700 | E | 5/2000 | McCarthy |
| 6,080,015 | A | 6/2000 | Andreescu |
| 6,089,912 | A | 7/2000 | Tanis et al. |
| 6,089,913 | A | 7/2000 | Holliday |
| 6,146,197 | A | 11/2000 | Holliday et al. |
| 6,159,046 | A | 12/2000 | Wong |
| 6,168,455 | B1 | 1/2001 | Hussaini |
| 6,217,380 | B1 | 4/2001 | Nelson et al. |
| 6,293,004 | B1 | 9/2001 | Holliday |
| 6,396,367 | B1 | 5/2002 | Rosenberger |
| 6,409,536 | B1 | 6/2002 | Kanda et al. |
| 6,471,545 | B1 | 10/2002 | Hosier, Sr. |
| 6,536,103 | B1 | 3/2003 | Holland et al. |
| 6,551,136 | B2 | 4/2003 | Johnsen et al. |
| 6,607,398 | B2 | 8/2003 | Henningsen |
| 6,634,906 | B1 | 10/2003 | Yeh |
| 6,648,683 | B2 | 11/2003 | Youtsey |
| 6,667,440 | B2 | 12/2003 | Nelson et al. |
| 6,733,336 | B1 | 5/2004 | Montena et al. |
| 6,780,052 | B2 | 8/2004 | Montena et al. |
| 6,808,415 | B1 | 10/2004 | Montena |
| 6,808,417 | B2 | 10/2004 | Yoshida |
| 6,840,803 | B2 | 1/2005 | Wlos et al. |
| 6,887,103 | B2 | 5/2005 | Montena et al. |
| 6,994,588 | B2 | 2/2006 | Montena |
| 7,011,546 | B2 | 3/2006 | Vaccaro |
| 7,029,304 | B2 | 4/2006 | Montena |
| 7,044,785 | B2 | 5/2006 | Harwath et al. |
| 7,104,839 | B2 | 9/2006 | Henningsen |
| 7,108,547 | B2 | 9/2006 | Kisling et al. |
| 7,127,806 | B2 | 10/2006 | Nelson et al. |
| 7,128,603 | B2 | 10/2006 | Burris et al. |
| 7,140,914 | B2 | 11/2006 | Kojima |
| 7,207,838 | B2 | 4/2007 | Andreescu |
| 7,217,154 | B2 | 5/2007 | Harwath |
| 7,261,581 | B2 | 8/2007 | Henningsen |
| 7,275,957 | B1 | 10/2007 | Wlos |
| 7,311,554 | B1 | 12/2007 | Jackson et al. |
| 7,335,059 | B2 | 2/2008 | Vaccaro |
| 7,357,671 | B2 | 4/2008 | Wild et al. |
| 7,381,089 | B2 * | 6/2008 | Hosler, Sr. ..... 439/578 |
| 7,384,307 | B1 | 6/2008 | Wang |
| 7,435,135 | B2 | 10/2008 | Wlos |
| 7,488,209 | B2 | 2/2009 | Vaccaro |
| 7,527,512 | B2 | 5/2009 | Montena |
| 7,588,460 | B2 | 9/2009 | Malloy et al. |
| 7,637,774 | B1 | 12/2009 | Vaccaro |
| 7,934,954 | B1 | 5/2011 | Chawgo et al. |
| 2001/0051448 | A1 | 12/2001 | Gonzales |
| 2005/0159043 | A1 | 7/2005 | Harwath et al. |
| 2005/0159044 | A1 | 7/2005 | Harwath et al. |
| 2007/0123101 | A1 | 5/2007 | Palinkas |
| 2007/0190854 | A1 | 8/2007 | Harwath |
| 2009/0019704 | A1 | 1/2009 | Ehret et al. |
| 2009/0233482 | A1 | 9/2009 | Chawgo et al. |
| 2011/0239451 | A1 | 10/2011 | Montena et al. |
| 2011/0244721 | A1 | 10/2011 | Amidon |
| 2011/0244722 | A1 | 10/2011 | Chawgo et al. |

FOREIGN PATENT DOCUMENTS

| | | | |
|---|---|---|---|
| EP | 0918370 | | 5/1999 |
| EP | 2063501 | A1 | 5/2009 |
| JP | 2002373743 | A | 12/2002 |

OTHER PUBLICATIONS

PCT/US2011/031012. International Search Report and Written Opinion. Date of Mailing: Nov. 11, 2011. 10 pages.

Amidon, J., Impedance Management in Coaxial Cable Terminations, U.S. Appl. No. 12/753,719, filed Apr. 2, 2010.

Montena, N. et al., Coaxial Cable Preparation Tools, U.S. Appl. No. 12/753,729, filed Apr. 2, 2010.

Chawgo, S. and Montena, N., Coaxial Cable Compression Connectors, U.S. Appl. No. 12/753,735, filed Apr. 2, 2010.

CN Patent Application No. 201110083541.1; Filed Apr. 2, 2011; Office Action, Date of Mailing Jul. 16, 2014; 11 pages.

* cited by examiner

METHOD OF TERMINATING A COAXIAL CABLE

BACKGROUND

Coaxial cable is used to transmit radio frequency (RF) signals in various applications, such as connecting radio transmitters and receivers with their antennas, computer network connections, and distributing cable television signals. Coaxial cable typically includes an inner conductor, an insulating layer surrounding the inner conductor, an outer conductor surrounding the insulating layer, and a protective jacket surrounding the outer conductor.

Each type of coaxial cable has a characteristic impedance which is the opposition to signal flow in the coaxial cable. The impedance of a coaxial cable depends on its dimensions and the materials used in its manufacture. For example, a coaxial cable can be tuned to a specific impedance by controlling the diameters of the inner and outer conductors and the dielectric constant of the insulating layer. All of the components of a coaxial system should have the same impedance in order to reduce internal reflections at connections between components. Such reflections increase signal loss and can result in the reflected signal reaching a receiver with a slight delay from the original.

Two sections of a coaxial cable in which it can be difficult to maintain a consistent impedance are the terminal sections on either end of the cable to which connectors are attached. For example, the attachment of some field-installable compression connectors requires the removal of a section of the insulating layer at the terminal end of the coaxial cable in order to insert a support structure of the compression connector between the inner conductor and the outer conductor. The support structure of the compression connector prevents the collapse of the outer conductor when the compression connector applies pressure to the outside of the outer conductor. Unfortunately, however, the dielectric constant of the support structure often differs from the dielectric constant of the insulating layer that the support structure replaces, which changes the impedance of the terminal ends of the coaxial cable. This change in the impedance at the terminal ends of the coaxial cable causes increased internal reflections, which results in increased signal loss.

Another difficulty with field-installable connectors, such as compression connectors or screw-together connectors, is maintaining acceptable levels of passive intermodulation (PIM). PIM in the terminal sections of a coaxial cable can result from nonlinear and insecure contact between surfaces of various components of the connector. A nonlinear contact between two or more of these surfaces can cause micro arcing or corona discharge between the surfaces, which can result in the creation of interfering RF signals. For example, some screw-together connectors are designed such that the contact force between the connector and the outer conductor is dependent on a continuing axial holding force of threaded components of the connector. Over time, the threaded components of the connector can inadvertently separate, thus resulting in nonlinear and insecure contact between the connector and the outer conductor.

Where the coaxial cable is employed on a cellular communications tower, for example, unacceptably high levels of PIM in terminal sections of the coaxial cable and resulting interfering RF signals can disrupt communication between sensitive receiver and transmitter equipment on the tower and lower-powered cellular devices. Disrupted communication can result in dropped calls or severely limited data rates, for example, which can result in dissatisfied customers and customer churn.

Current attempts to solve these difficulties with field-installable connectors generally consist of employing a pre-fabricated jumper cable having a standard length and having factory-installed soldered or welded connectors on either end. These soldered or welded connectors generally exhibit stable impedance matching and PIM performance over a wider range of dynamic conditions than current field-installable connectors. These pre-fabricated jumper cables are inconvenient, however, in many applications.

For example, each particular cellular communication tower in a cellular network generally requires various custom lengths of coaxial cable, necessitating the selection of various standard-length jumper cables that is each generally longer than needed, resulting in wasted cable. Also, employing a longer length of cable than is needed results in increased insertion loss in the cable. Further, excessive cable length takes up more space on the tower. Moreover, it can be inconvenient for an installation technician to have several lengths of jumper cable on hand instead of a single roll of cable that can be cut to the needed length. Also, factory testing of factory-installed soldered or welded connectors for compliance with impedance matching and PIM standards often reveals a relatively high percentage of non-compliant connectors. This percentage of non-compliant, and therefore unusable, connectors can be as high as about ten percent of the connectors in some manufacturing situations. For all these reasons, employing factory-installed soldered or welded connectors on standard-length jumper cables to solve the above-noted difficulties with field-installable connectors is not an ideal solution.

SUMMARY OF SOME EXAMPLE EMBODIMENTS

In general, example embodiments of the present invention relate to passive intermodulation (PIM) and impedance management in coaxial cable terminations. The PIM and impedance management disclosed herein is accomplished at least in part by creating an increased-diameter cylindrical section in an outer conductor of a coaxial cable during termination. The example embodiments disclosed herein improve impedance matching in coaxial cable terminations, thus reducing internal reflections and resulting signal loss associated with inconsistent impedance. Further, the example embodiments disclosed herein also improve mechanical and electrical contacts in coaxial cable terminations. Improved contacts result in reduced PIM levels and associated interfering RF signals, which can improve reliability and increase data rates between sensitive receiver and transmitter equipment on cellular communication towers and lower-powered cellular devices.

In one example embodiment, a method for terminating a coaxial cable is provided. The coaxial cable includes an inner conductor, an insulating layer surrounding the inner conductor, an outer conductor surrounding the insulating layer, and a jacket surrounding the outer conductor. The method includes various acts. First, a diameter of at least a portion of the outer conductor that surrounds a cored-out section of the insulating layer is increased so as to create an increased-diameter cylindrical section of the outer conductor. The increased-diameter cylindrical section has a length that is at least two times the thickness of the outer conductor. Next, at least a portion of an internal connector structure is inserted into the cored-out section so as to be surrounded by the increased-diameter cylindrical section. Finally, an external connector structure is clamped around the increased-diameter cylindrical section so as to radially compress the increased-diameter cylindrical section between the external connector structure and the internal connector structure, and via a single action, a contact force between the inner conductor and a conductive pin is increased.

In another example embodiment, a method for terminating a corrugated coaxial cable is provided. The corrugated coaxial cable includes an inner conductor, an insulating layer surrounding the inner conductor, a corrugated outer conductor having peaks and valleys and surrounding the insulating layer, and a jacket surrounding the corrugated outer conductor. The method includes various acts. First, a terminal section of the insulating layer is cored out. Next, a diameter of one or more of the valleys of the corrugated outer conductor that surround the cored-out section are increased so as to create an increased-diameter cylindrical section of the corrugated outer conductor. The corrugated outer conductor has a length that is at least two times the thickness of the corrugated outer conductor. Then, at least a portion of a connector mandrel is inserted into the cored-out section so as to be surrounded by the increased-diameter cylindrical section. Next, a connector clamp is clamped around the increased-diameter cylindrical section so as to radially compress the increased-diameter cylindrical section between the connector clamp and the connector mandrel, and via a single action, a contact force between the inner conductor and a conductive pin is increased.

In yet another example embodiment, a method for terminating a smooth-walled coaxial cable is provided. The smooth-walled coaxial cable includes an inner conductor, an insulating layer surrounding the inner conductor, a smooth-walled outer conductor surrounding the insulating layer, and a jacket surrounding the smooth-walled outer conductor. The method includes various acts. First, a terminal section of the insulating layer is cored out. Next, a diameter of at least a portion of the smooth-walled outer conductor that surrounds the cored-out section is increased so as to create an increased-diameter cylindrical section of the smooth-walled outer conductor. The increased-diameter cylindrical section has a length that is at least two times the thickness of the smooth-walled outer conductor. Then, at least a portion of a connector mandrel is inserted into the cored-out section so as to be surrounded by the increased-diameter cylindrical section. Finally, a connector clamp is clamped around the increased-diameter cylindrical section so as to radially compress the increased-diameter cylindrical section between the connector clamp and the connector mandrel.

This Summary is provided to introduce a selection of concepts in a simplified form that are further described below in the Detailed Description. This Summary is not intended to identify key features or essential characteristics of the claimed subject matter, nor is it intended to be used as an aid in determining the scope of the claimed subject matter. Moreover, it is to be understood that both the foregoing general description and the following detailed description of the present invention are exemplary and explanatory and are intended to provide further explanation of the invention as claimed.

BRIEF DESCRIPTION OF THE DRAWINGS

Aspects of example embodiments of the present invention will become apparent from the following detailed description of example embodiments given in conjunction with the accompanying drawings, in which.

DETAILED DESCRIPTION OF SOME EXAMPLE EMBODIMENTS

Example embodiments of the present invention relate to passive intermodulation (PIM) and impedance management in coaxial cable terminations. In the following detailed description of some example embodiments, reference will now be made in detail to example embodiments of the present invention which are illustrated in the accompanying drawings. Wherever possible, the same reference numbers will be used throughout the drawings to refer to the same or like parts. These embodiments are described in sufficient detail to enable those skilled in the art to practice the invention. Other embodiments may be utilized and structural, logical and electrical changes may be made without departing from the scope of the present invention. Moreover, it is to be understood that the various embodiments of the invention, although different, are not necessarily mutually exclusive. For example, a particular feature, structure, or characteristic described in one embodiment may be included within other embodiments. The following detailed description is, therefore, not to be taken in a limiting sense, and the scope of the present invention is defined only by the appended claims, along with the full scope of equivalents to which such claims are entitled.

I. Example Corrugated Coaxial Cable and Example Connector

Figure 1A:
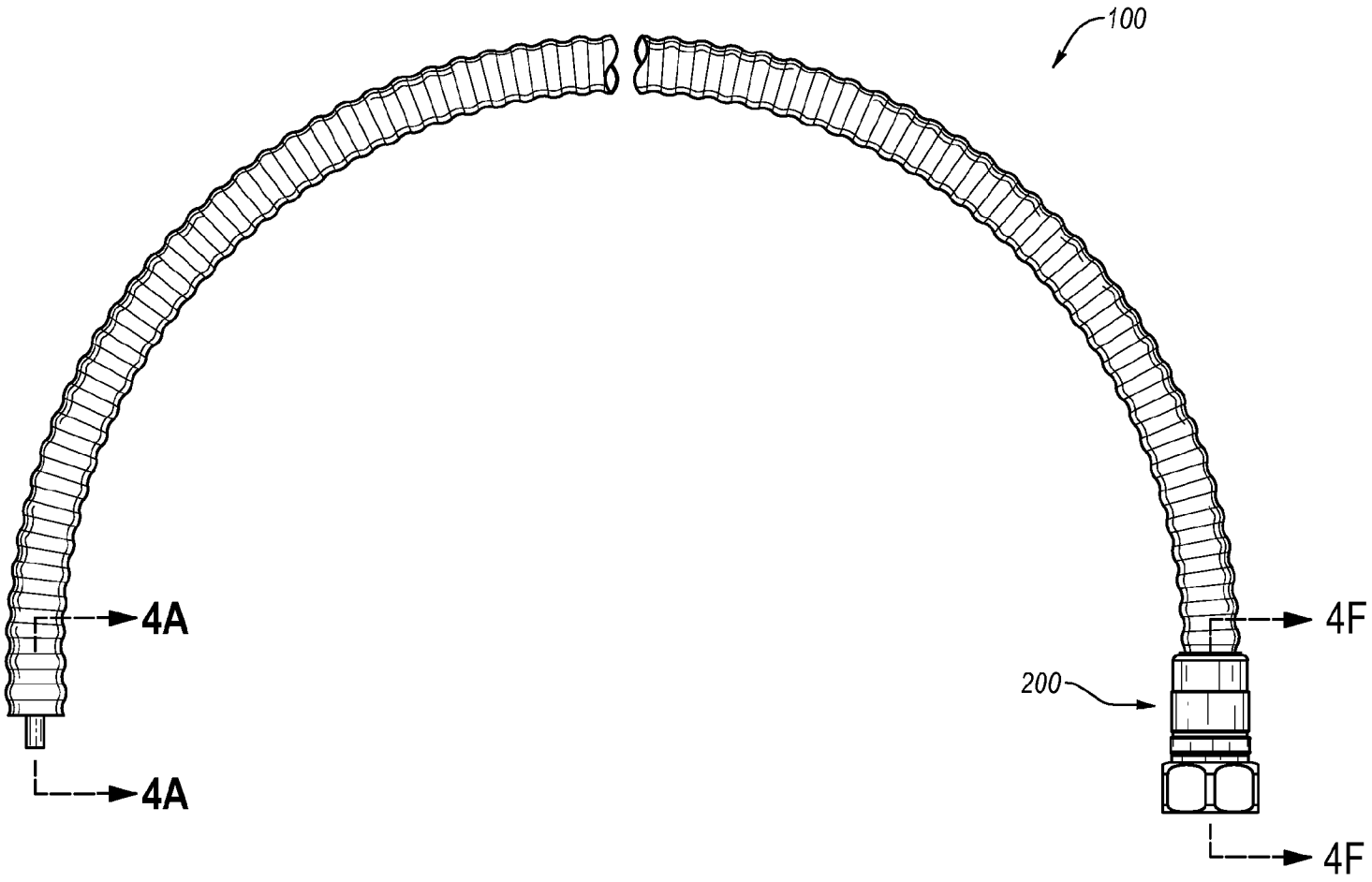
FIG. 1A is a perspective view of an example corrugated coaxial cable terminated on one end with an example compression connector.

With reference now to FIG. 1A, a first example coaxial cable 100 is disclosed. The example coaxial cable 100 has 50 Ohms of impedance and is a ½" series corrugated coaxial cable. It is understood, however, that these cable characteristics are example characteristics only, and that the example termination methods disclosed herein can also benefit coaxial cables with other impedance, dimension, and shape characteristics.

Also disclosed in FIG. 1A, the example coaxial cable 100 is terminated on the right side of FIG. 1A with an example compression connector 200. Although the example compression connector 200 is disclosed in FIG. 1A as a male compression connector, it is understood that the compression connector 200 can instead be configured as a female compression connector (not shown).

Figure 1B:
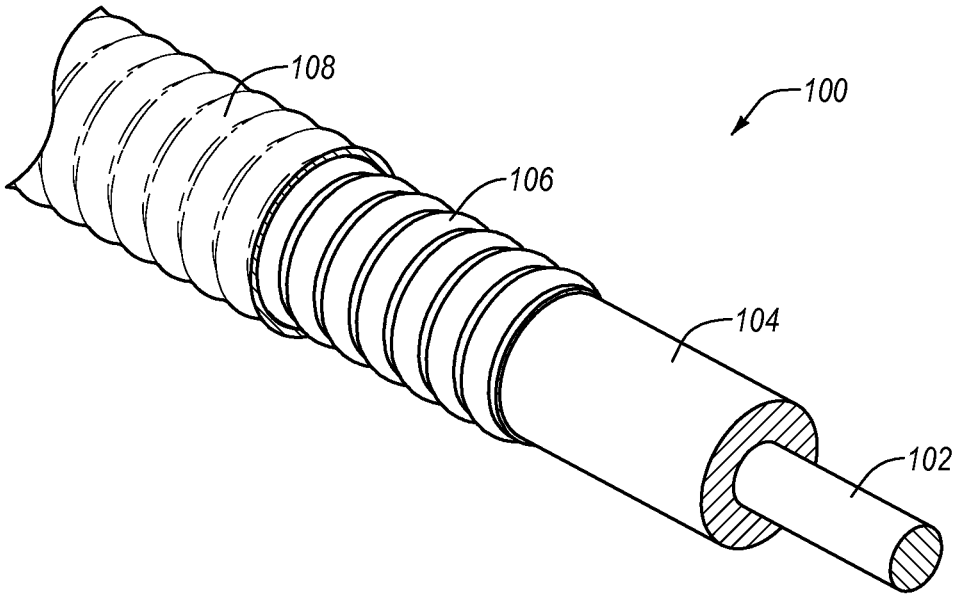
FIG. 1B is a perspective view of a portion of the example corrugated coaxial cable of FIG. 1A, the perspective view having portions of each layer of the example corrugated coaxial cable cut away.

With reference now to FIG. 1B, the coaxial cable 100 generally includes an inner conductor 102 surrounded by an insulating layer 104, a corrugated outer conductor 106 surrounding the insulating layer 104, and a jacket 108 surrounding the corrugated outer conductor 106. As used herein, the phrase "surrounded by" refers to an inner layer generally being encased by an outer layer. However, it is understood that an inner layer may be "surrounded by" an outer layer without the inner layer being immediately adjacent to the outer layer. The term "surrounded by" thus allows for the possibility of intervening layers. Each of these components of the example coaxial cable 100 will now be discussed in turn.

The inner conductor 102 is positioned at the core of the example coaxial cable 100 and may be configured to carry a range of electrical current (amperes) and/or RF/electronic digital signals. The inner conductor 102 can be formed from copper, copper-clad aluminum (CCA), copper-clad steel (CCS), or silver-coated copper-clad steel (SCCCS), although other conductive materials are also possible. For example, the inner conductor 102 can be formed from any type of conductive metal or alloy. In addition, although the inner conductor 102 of FIG. 1B is clad, it could instead have other configurations such as solid, stranded, corrugated, plated, or hollow, for example.

The insulating layer 104 surrounds the inner conductor 102, and generally serves to support the inner conductor 102 and insulate the inner conductor 102 from the outer conductor 106. Although not shown in the figures, a bonding agent, such as a polymer, may be employed to bond the insulating layer 104 to the inner conductor 102. As disclosed in FIG. 1B, the insulating layer 104 is formed from a foamed material such as, but not limited to, a foamed polymer or fluoropolymer. For example, the insulating layer 104 can be formed from foamed polyethylene (PE).

The corrugated outer conductor 106 surrounds the insulating layer 104, and generally serves to minimize the ingress and egress of high frequency electromagnetic radiation to/from the inner conductor 102. In some applications, high frequency electromagnetic radiation is radiation with a frequency that is greater than or equal to about 50 MHz. The corrugated outer conductor 106 can be formed from solid copper, solid aluminum, copper-clad aluminum (CCA), although other conductive materials are also possible. The corrugated configuration of the corrugated outer conductor 106, with peaks and valleys, enables the coaxial cable 100 to be flexed more easily than cables with smooth-walled outer conductors.

The jacket 108 surrounds the corrugated outer conductor 106, and generally serves to protect the internal components of the coaxial cable 100 from external contaminants, such as dust, moisture, and oils, for example. In a typical embodiment, the jacket 108 also functions to limit the bending radius of the cable to prevent kinking, and functions to protect the cable (and its internal components) from being crushed or otherwise misshapen from an external force. The jacket 108 can be formed from a variety of materials including, but not limited to, polyethylene (PE), high-density polyethylene (HDPE), low-density polyethylene (LDPE), linear low-density polyethylene (LLDPE), rubberized polyvinyl chloride (PVC), or some combination thereof. The actual material used in the formation of the jacket 108 might be indicated by the particular application/environment contemplated.

It is understood that the insulating layer 104 can be formed from other types of insulating materials or structures having a dielectric constant that is sufficient to insulate the inner conductor 102 from the outer conductor 106. For example, as disclosed in FIG. 1C, an alternative coaxial cable 100' includes an alternative insulating layer 104' composed of a spiral-shaped spacer that enables the inner conductor 102 to be generally separated from the corrugated outer conductor 106 by air. The spiral-shaped spacer of the alternative insulating layer 104' may be formed from polyethylene or polypropylene, for example. The combined dielectric constant of the spiral-shaped spacer and the air in the alternative insulating layer 104' would be sufficient to insulate the inner conductor 102 from the corrugated outer conductor 106 in the alternative coaxial cable 100'. Further, the example termination methods disclosed herein can similarly benefit the alternative coaxial cable 100'.

In addition, it is understood that the corrugated outer conductor 106 can be either annular corrugated outer conductor, as disclosed in the figures, or can be helical corrugated outer conductor (not shown). Further, the example termination methods disclosed herein can similarly benefit a coaxial cable with a helical corrugated outer conductor (not shown).

II. Example Smooth-Walled Coaxial Cable and Example Connector

Figure 2A:
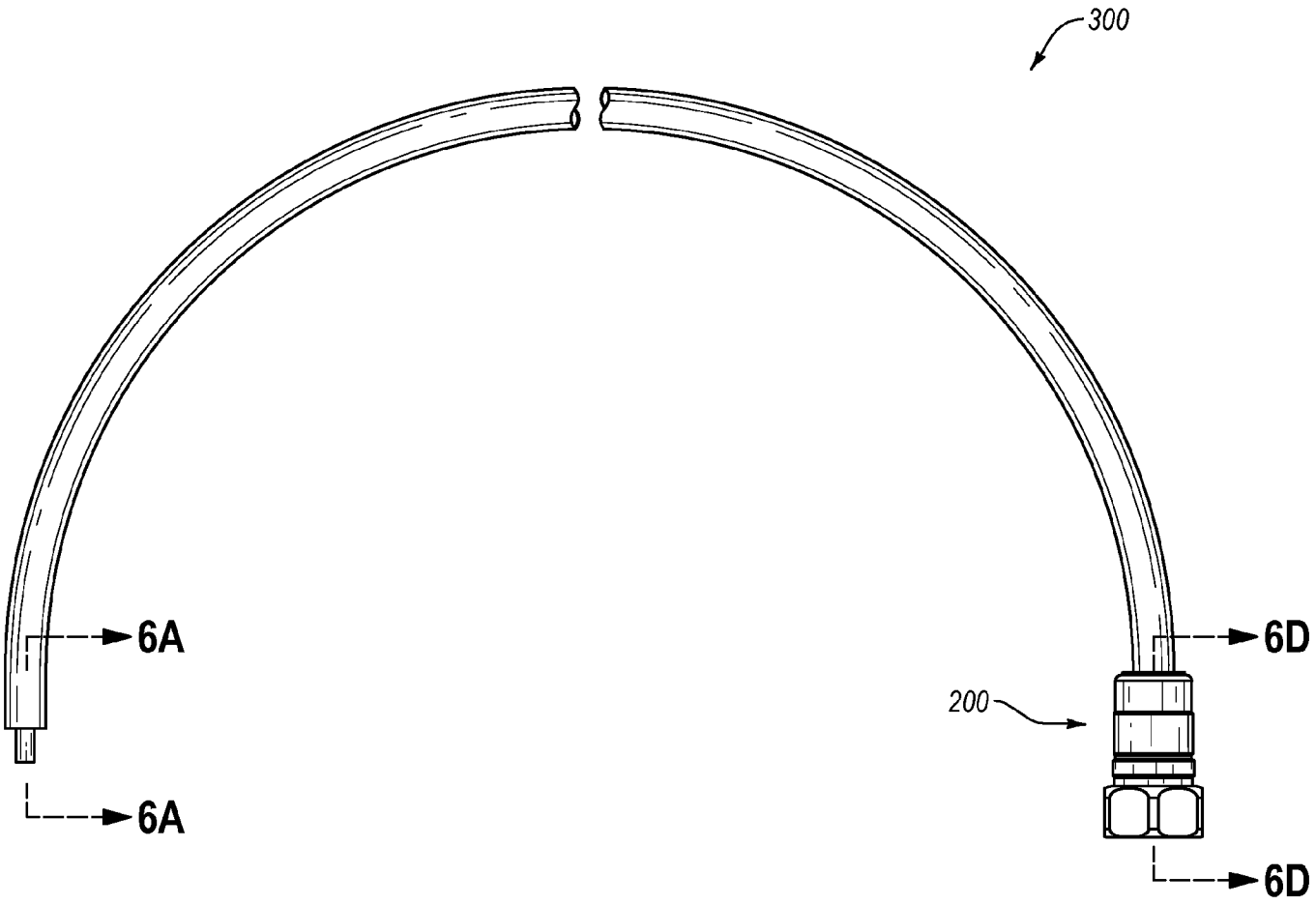
FIG. 2A is a perspective view of an example smooth-walled coaxial cable terminated on one end with another example compression connector.

With reference now to FIG. 2A, a second example coaxial cable 300 is disclosed. The example coaxial cable 300 also has 50 Ohms of impedance and is a ½" series smooth-walled coaxial cable. It is understood, however, that these cable characteristics are example characteristics only, and that the example termination methods disclosed herein can also benefit coaxial cables with other impedance, dimension, and shape characteristics.

Also disclosed in FIG. 2A, the example coaxial cable 300 is also terminated on the right side of FIG. 2A with an example connector 200 that is identical to the example connector in FIG. 1A.

Figure 2B:
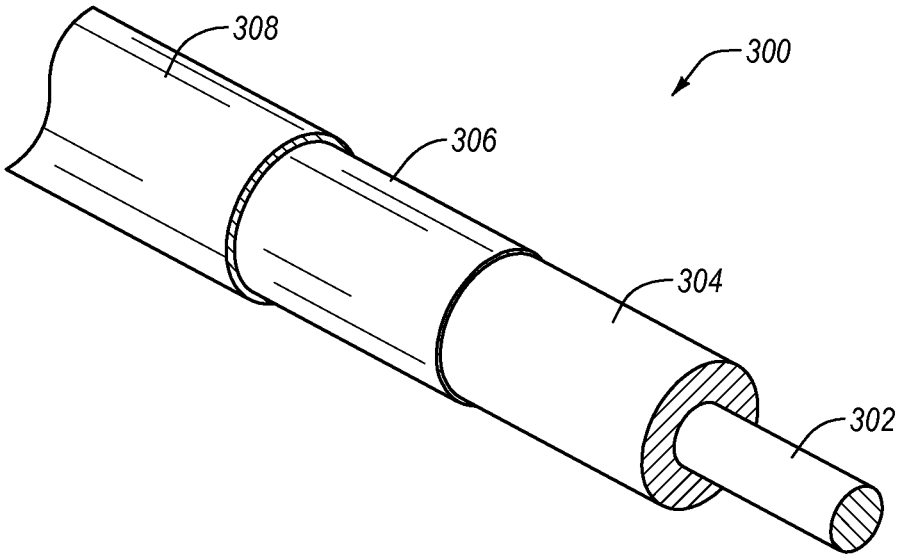
FIG. 2B is a perspective view of a portion of the example smooth-walled coaxial cable of FIG. 2A, the perspective view having portions of each layer of the example smooth-walled coaxial cable cut away.

With reference now to FIG. 2B, the example coaxial cable 300 generally includes an inner conductor 302 surrounded by an insulating layer 304, a smooth-walled outer conductor 306 surrounding the insulating layer 304, and a jacket 308 surrounding the smooth-walled outer conductor 306. The inner conductor 302 and insulating layer 304 are identical in form and function to the inner conductor 102 and insulating layer 104, respectively, of the example coaxial cable 100. Further, the smooth-walled outer conductor 306 and jacket 308 are identical in form and function to the corrugated outer conductor 106 and jacket 108, respectively, of the example coaxial cable 100, except that the smooth-walled outer conductor 306 and jacket 308 are smooth-walled instead of corrugated. The smooth-walled configuration of the smooth-walled outer conductor 306 enables the coaxial cable 300 to be generally more rigid than cables with corrugated outer conductors.

Figure 1C:
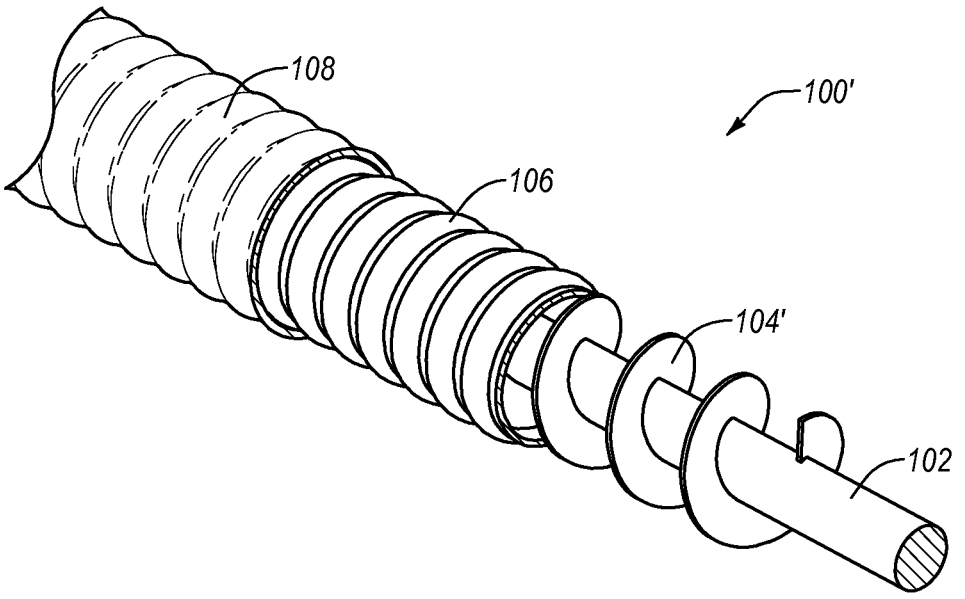
FIG. 1C is a perspective view of a portion of an alternative corrugated coaxial cable, the perspective view having portions of each layer of the alternative corrugated coaxial cable cut away.
Figure 2C:
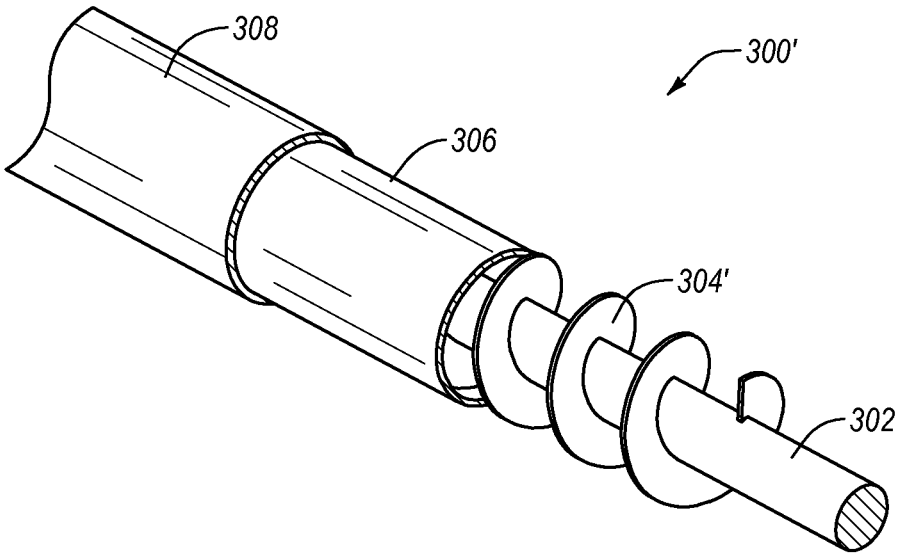
FIG. 2C is a perspective view of a portion of an alternative smooth-walled coaxial cable, the perspective view having portions of each layer of the alternative smooth-walled coaxial cable cut away.

As disclosed in FIG. 2C, an alternative coaxial cable 300' includes an alternative insulating layer 304' composed of a spiral-shaped spacer that is identical in form and function to the alternative insulating layer 104' of FIG. 1C. Accordingly, the example termination methods disclosed herein can similarly benefit the alternative coaxial cable 300'.

III. Example Method for Terminating a Coaxial Cable

Figure 3:
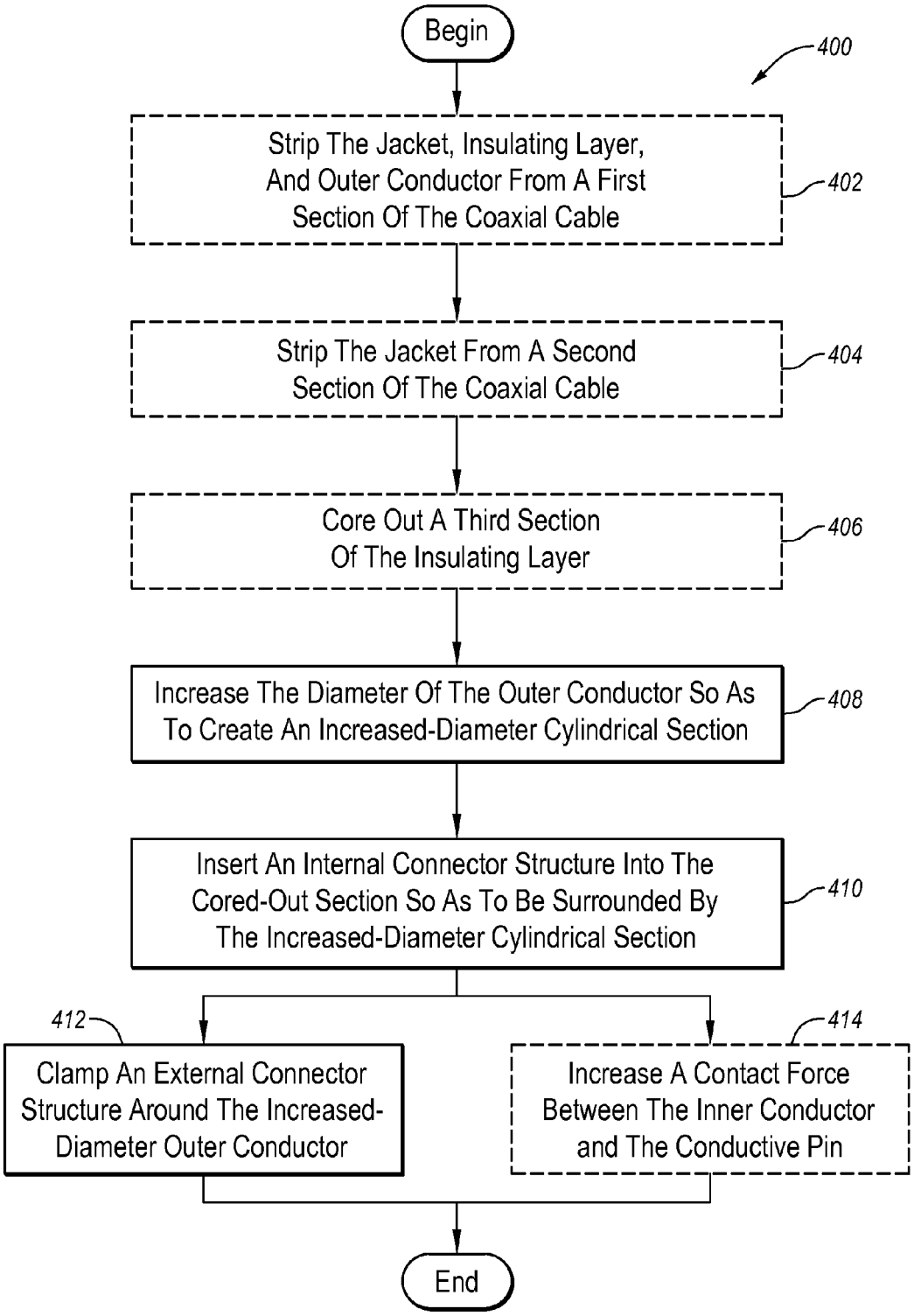
FIG. 3 is a flowchart of an example method for terminating a coaxial cable.

With reference to FIG. 3, an example method 400 for terminating a coaxial cable is disclosed. For example, the example method 400 can be employed to terminate the corrugated coaxial cable 100 or 100' of FIGS. 1A-1C or the smooth-walled coaxial cable 300 or 300' of FIGS. 2A-2C. The example method 400 enables a coaxial cable to be terminated with a connector while maintaining a substantially consistent impedance along the entire length of the coaxial cable, thus reducing internal reflections and resulting signal loss associated with inconsistent impedance. Further, the example method 400 enables a coaxial cable to be terminated with a connector with acceptably low levels of PIM, thus reducing the creation of interfering RF signals and the resulting disrupted communication associated with unacceptably high levels of PIM.

IV. First Embodiment of the Method for Terminating a Coaxial Cable

Figure 4A:
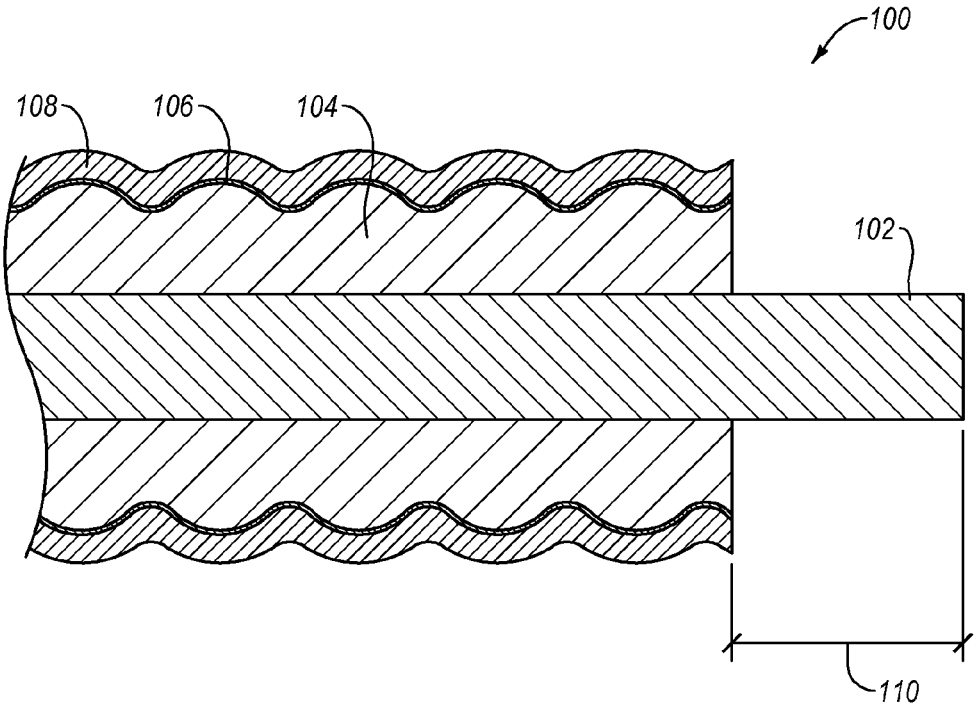
FIGS. 4A-4D are various cross-sectional side views of a terminal end of the example corrugated coaxial cable of FIG. 1A during various stages of the example method of FIG. 3.

With reference to FIGS. 3 and 4A-4L, a first example embodiment of the method 400 in terminating the example corrugated coaxial cable 100 will now be disclosed. With reference to FIGS. 3 and 4A, the method 400 begins with an act 402 in which the jacket 108, corrugated outer conductor 106, and insulating layer 104 is stripped from a first section 110 of the coaxial cable 100 so as to expose the first section 110 of the inner conductor 102. This stripping of the jacket 108, corrugated outer conductor 106, and insulating layer 104 can be accomplished using a stripping tool (not shown). For example, in the example embodiment disclosed in FIG. 4A, a stripping tool was used to strip 0.41 inches of the jacket 108, corrugated outer conductor 106, and insulating layer 104 from the stripped section 110 of the coaxial cable 100. The length of 0.41 inches corresponds to the length of exposed inner conductor 102 required by the connector 200 (see FIG. 1A), although it is understood that other lengths are contemplated to correspond to the requirements of other connectors. Alternatively, the step 402 may be omitted altogether where the jacket 108, corrugated outer conductor 106, and insulating layer 104 have been pre-stripped from the section 110 of the coaxial cable 100 prior to the performance of the example method 400, or where the corresponding connector does not require the inner conductor 102 to extend beyond the terminal end of the coaxial cable 100.

Figure 4B:
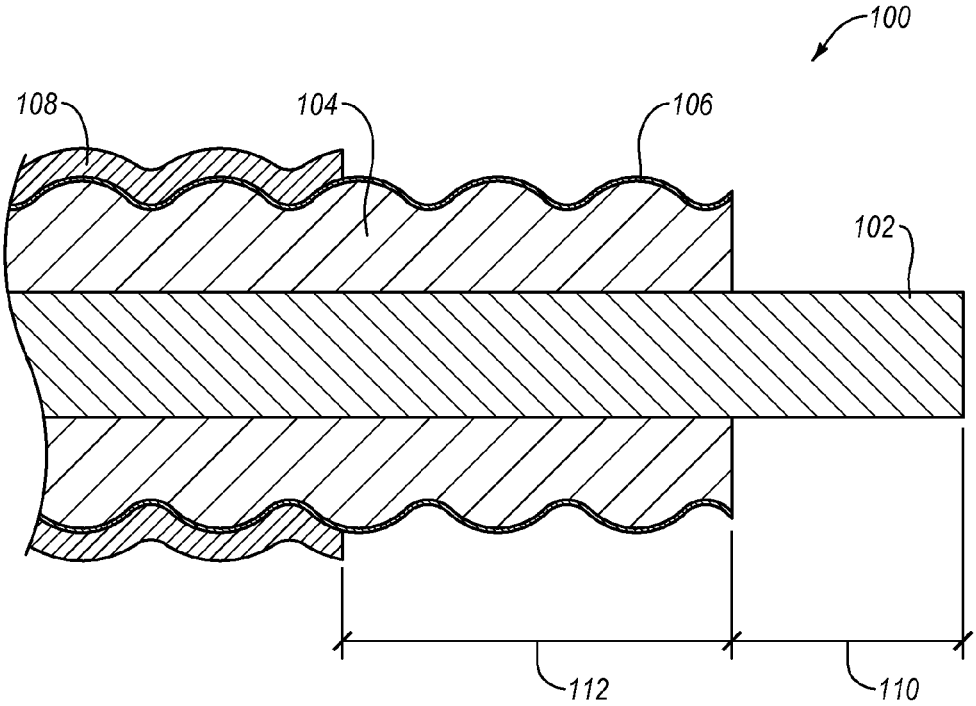

With reference to FIGS. 3 and 4B, the method 400 continues with an act 404 in which the jacket 108 is stripped from a second section 112 of the coaxial cable 100. This stripping of the jacket 108 can be accomplished using a stripping tool (not shown) that is configured to automatically expose the section 112 of the corrugated outer conductor 106 of the coaxial cable 100. For example, in the example embodiment disclosed in FIG. 4B, a stripping tool was used to strip 0.68 inches of the jacket 108 from the stripped section 112 of the coaxial cable 100. The length of 0.68 inches corresponds to the length of exposed corrugated outer conductor 106 required by the connector 200 (see FIG. 1A), although it is understood that other lengths are contemplated to correspond to the requirements of other connectors. Alternatively, the step 404 may be omitted altogether where the jacket 108 has been pre-stripped from the section 112 of the coaxial cable 100 prior to the performance of the example method 400.

Figure 4C:
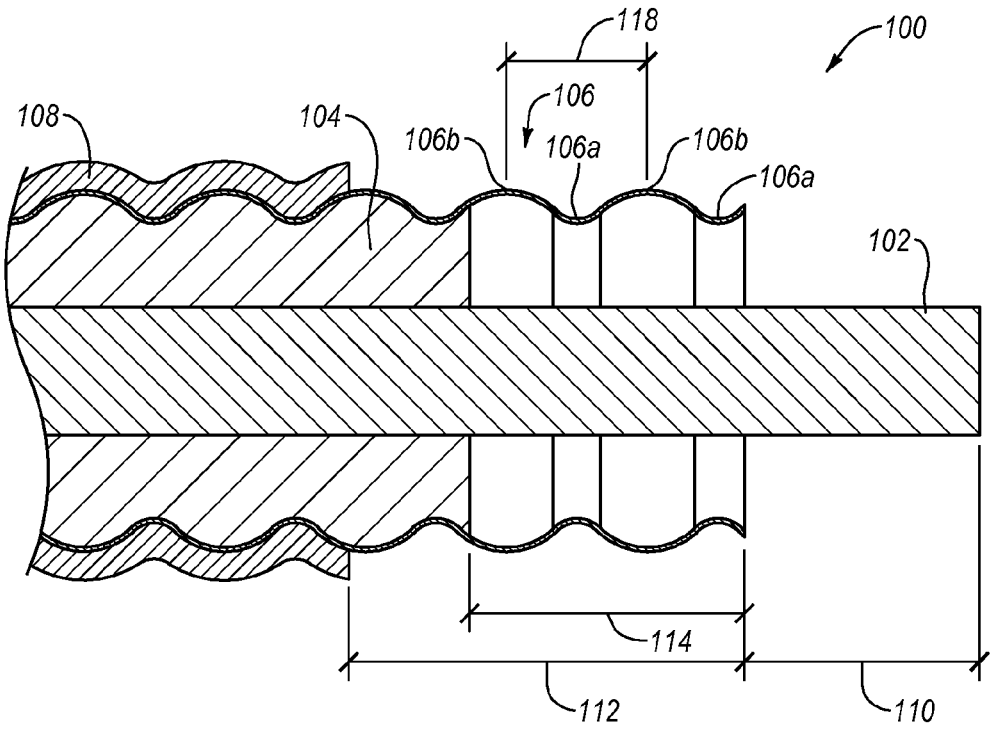

With reference to FIGS. 3 and 4C, the method 400 continues with an act 406 in which a section 114 of the insulating layer 104 is cored out. This coring-out of the insulating layer 104 can be accomplished using a coring tool (not shown) that is configured to automatically expose the section 114 of the inner conductor 102 and the inside surface of the corrugated outer conductor 106 of the coaxial cable 100. For example, in the example embodiment disclosed in FIG. 4C, a coring tool was used to core out 0.475 inches of the insulating layer 104 from the cored-out section 114 of the coaxial cable 100. The length of 0.475 inches corresponds to the length of cored-out insulating layer 104 required by the connector 200 (see FIG. 1A), although it is understood that other lengths are contemplated to correspond to the requirements of other connectors. Alternatively, the step 406 may be omitted altogether where the insulating layer 104 has been pre-cored out from the section 114 of the coaxial cable 100 prior to the performance of the example method 400.

Figure 4D:
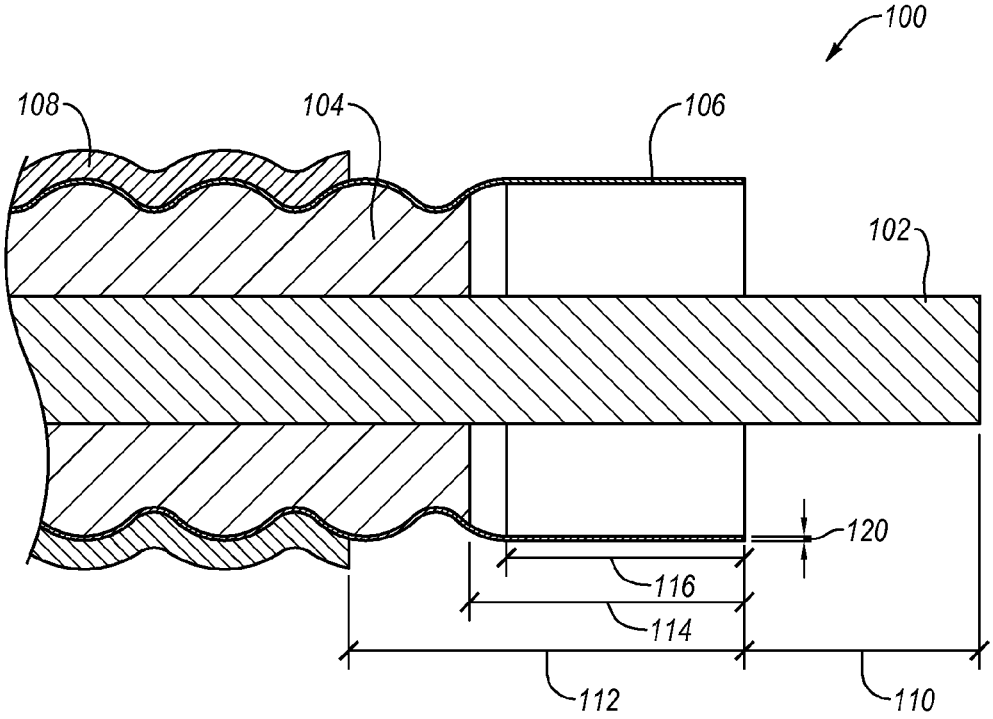

Although the insulating layer 104 is shown in FIG. 4D as extending all the way to the top of the peaks 106*b* of the corrugated outer conductor 106, it is understood that an air gap may exist between the insulating layer 104 and the top of the peaks 106*b*. Further, although the jacket 108 is shown in the FIG. 4D as extending all the way to the bottom of the valleys 106*a* of the corrugated outer conductor 106, it is understood that an air gap may exist between the jacket 108 and the bottom of the valleys 106*a*.

With reference to FIGS. 3 and 4D, the method 400 continues with an act 408 in which the diameter of a portion of the corrugated outer conductor 106 that surrounds the cored-out section 114 is increased so as to create an increased-diameter cylindrical section 116 of the outer conductor 106. The term "cylindrical" as used herein refers to a component having a section or surface with a substantially uniform diameter throughout the length of the section or surface. It is understood, therefore, that a "cylindrical" section or surface may have minor imperfections or irregularities in the roundness or consistency throughout the length of the section or surface. It is further understood that a "cylindrical" section or surface may have an intentional distribution or pattern of features, such as grooves or teeth, but nevertheless on average has a substantially uniform diameter throughout the length of the section or surface.

This increasing of the diameter of the corrugated outer conductor 106 can be accomplished using any of the tools disclosed in co-pending U.S. patent application Ser. No. 12/753,729, titled "COAXIAL CABLE PREPARATION TOOLS," filed Apr. 2, 20120 and incorporated herein by reference in its entirety. Alternatively, this increasing of the diameter of the corrugated outer conductor 106 can be accomplished using other tools, such as a common pipe expander.

As disclosed in FIGS. 4C and 4D, the act 408 can be accomplished by increasing a diameter of one or more of the valleys of the corrugated outer conductor 108 that surround the cored-out section 114. For example, the diameters of the valleys 106*a* of FIG. 4C can be increased until they are equal to the diameters of the peaks 106*b* of FIG. 4C, resulting in an increased-diameter cylindrical section 116 disclosed in FIG. 4D. It is understood, however, that the diameter of the increased-diameter cylindrical section 116 of the outer conductor 106 can be greater than the diameter of the peaks 106*b* of FIG. 4C. Alternatively, the diameter of the increased-diameter cylindrical section 116 of the outer conductor 106 can be greater than the diameter of the valleys 106*a* of FIG. 4C but less than the diameter of the peaks 106*b* of FIG. 4C.

As disclosed in FIG. 4D, the increased-diameter cylindrical section 116 of the corrugated outer conductor 106 has a substantially uniform diameter throughout the length of the section 116. The length of the increased-diameter cylindrical section 116 should be sufficient to allow a force to be directed inward on the cylindrical section 116, once the corrugated coaxial cable 100 is terminated with the example compression connector 200, with the inwardly-directed force having primarily a radial component and having substantially no axial component. As disclosed in FIGS. 4C and 4D, the increased-diameter cylindrical section 116 of the corrugated outer conductor has a length greater than the distance 118 spanning the two adjacent peaks 106*b* of the corrugated outer conductor 106. As disclosed in FIG. 4D, the length of the increased-diameter cylindrical section 116 is thirty-three times the thickness 120 of the outer conductor 106. It is understood, however, that the length of the increased-diameter cylindrical section 116 could instead be as little as two times the thickness 120 of the outer conductor 106, or could instead be greater than thirty-three times the thickness 120 of the outer conductor 106. It is further understood that the tools and/or processes that accomplish the act 408 may further create increased-diameter portions of the corrugated outer conductor 106 that are not cylindrical in addition to creating the increased-diameter cylindrical section 116.

Figure 4E:
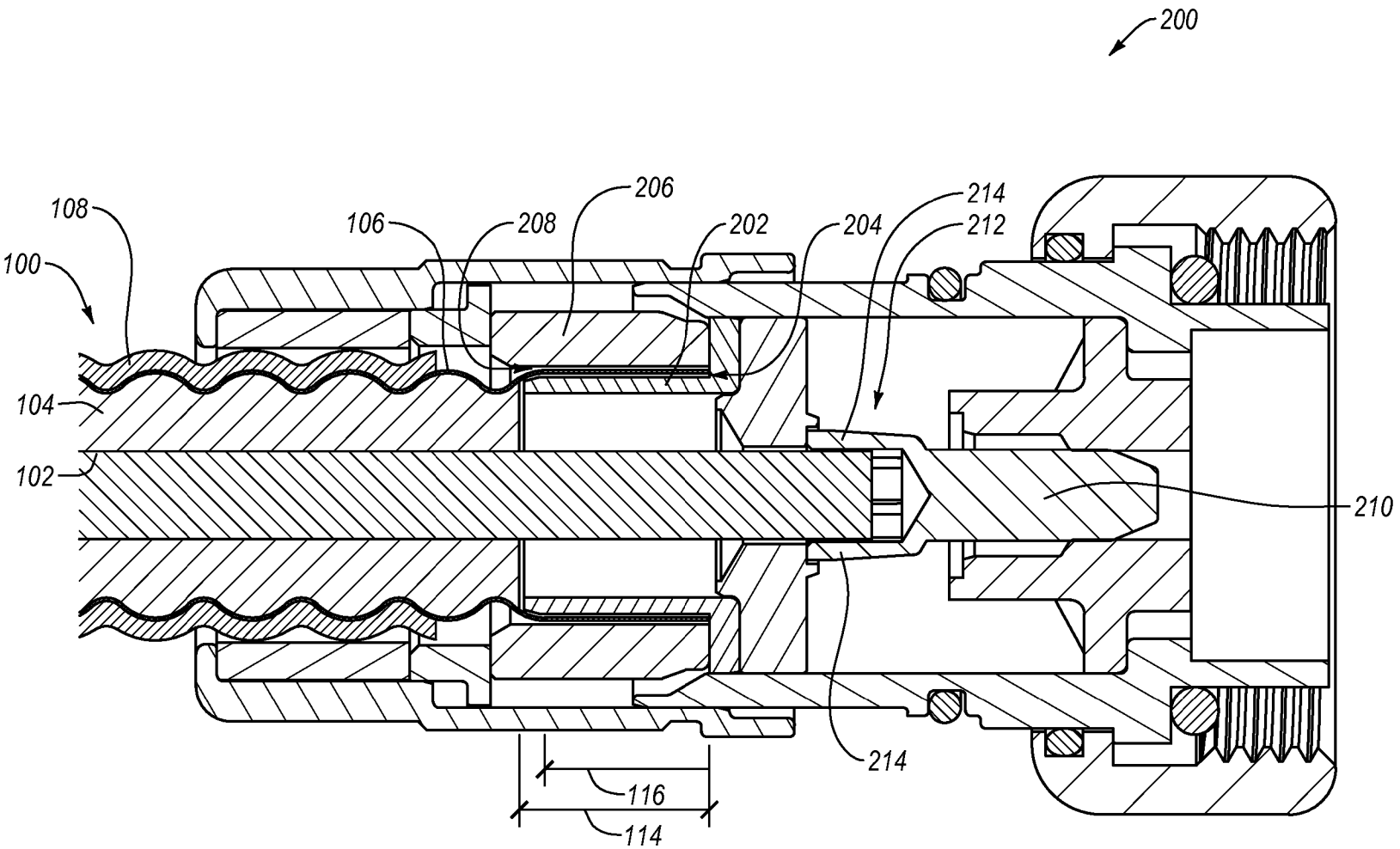
FIG. 4E is a cross-sectional side view of the terminal end of the example corrugated coaxial cable of FIG. 4D after having been inserted into the example connector of FIG. 1A, with the example compression connector being in an open position.

With reference to FIGS. 3 and 4E, the method 400 continues with an act 410 in which at least a portion of an internal connector structure 202 is inserted into the cored-out section 114 so as to be surrounded by the increased-diameter cylindrical section 116 of the outer conductor 106. The inserted portion of the internal connector structure 202 is configured as a mandrel that has an outside diameter that is slightly smaller than the inside diameter of the increased-diameter cylindrical section 116 of the outer conductor 106. As disclosed in FIG. 4E, this slightly smaller outside diameter enables the increased-diameter cylindrical section 116 to be inserted into the connector 200 and slip over the internal connector structure 202, leaving a gap 204 between the internal connector structure 202 and the increased-diameter cylindrical section 116.

Although the majority of the inserted portion of the internal connector structure 202 is generally cylindrical, it is understood that portions of the inserted portion of the internal connector structure 202 may be non-cylindrical. For example, the leading edge of the inserted portion of the internal connector structure 202 tapers inward in order to facilitate the insertion of the internal connector structure 202 into the cored-out section 114. Further, additional portions of the inserted portion of the internal connector structure 202 may be non-cylindrical for various reasons. For example, the outside surface of the inserted portion of the internal connector structure 202 may include steps, grooves, or ribs in order achieve mechanical and electrical contact with the increased-diameter cylindrical section 116.

Further, once inserted into the connector 200, the increased-diameter cylindrical section 116 is surrounded by an external connector structure 206. The external connector structure 206 is configured as a clamp that has an inside diameter that is slightly larger than the outside diameter of the increased-diameter cylindrical section 116 of the outer conductor 106. As disclosed in FIG. 4E, this slightly larger inside diameter enables the increased-diameter cylindrical section 116 to be surrounded by the external connector structure 206, leaving a gap 208 between the increased-diameter cylindrical section 116 and the external connector structure 206. Also, once inserted into the connector 200, the inner conductor 102 of the coaxial cable 100 is received into a collet portion 212 of a conductive pin 210 such that the conductive pin 210 is mechanically and electrically contacting the inner conductor 102.

Figure 4F:
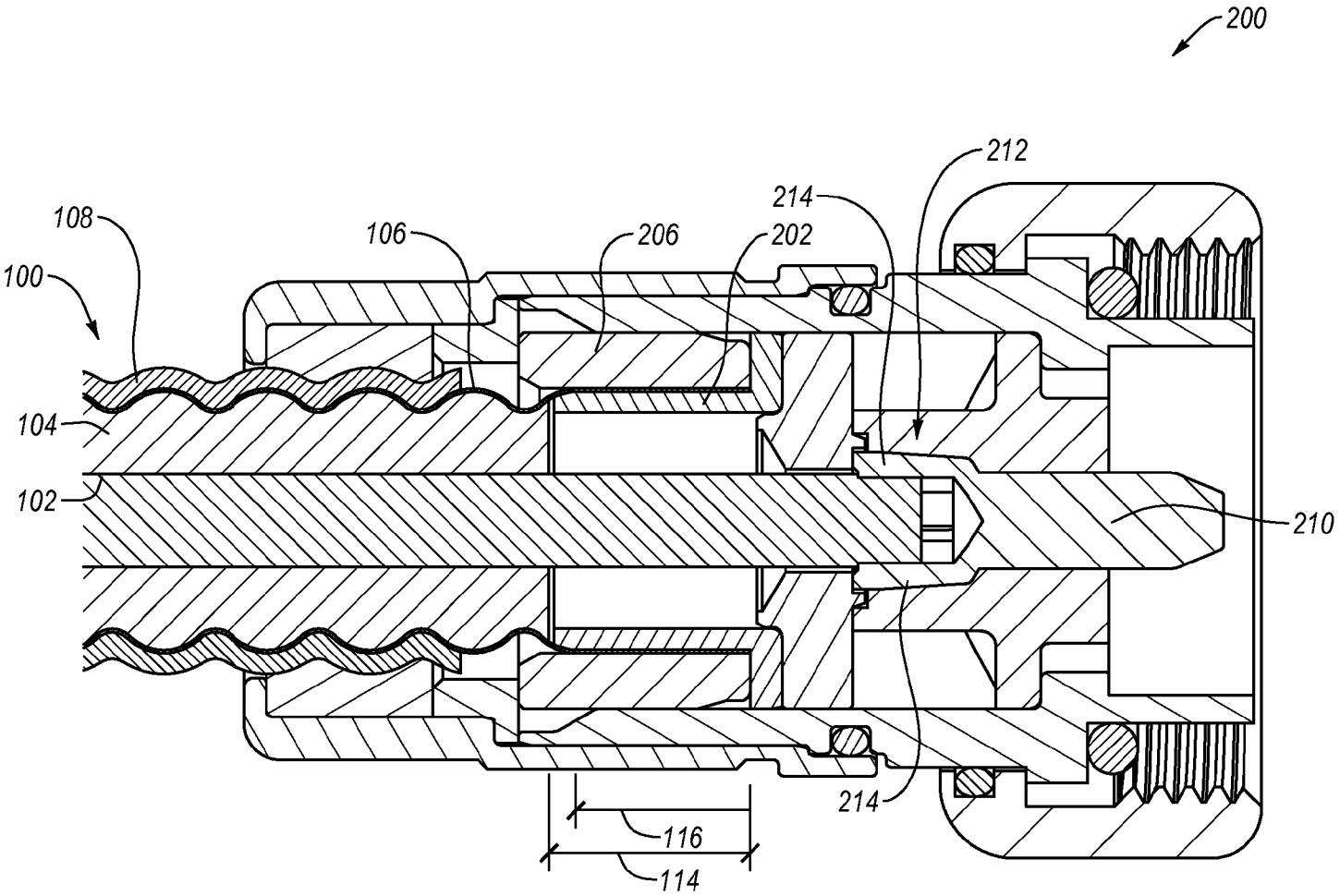
FIG. 4F is a cross-sectional side view of the terminal end of the example corrugated coaxial cable of FIG. 4D after having been inserted into the example connector of FIG. 1A, with the example compression connector being in an engaged position.
Figure 4G:
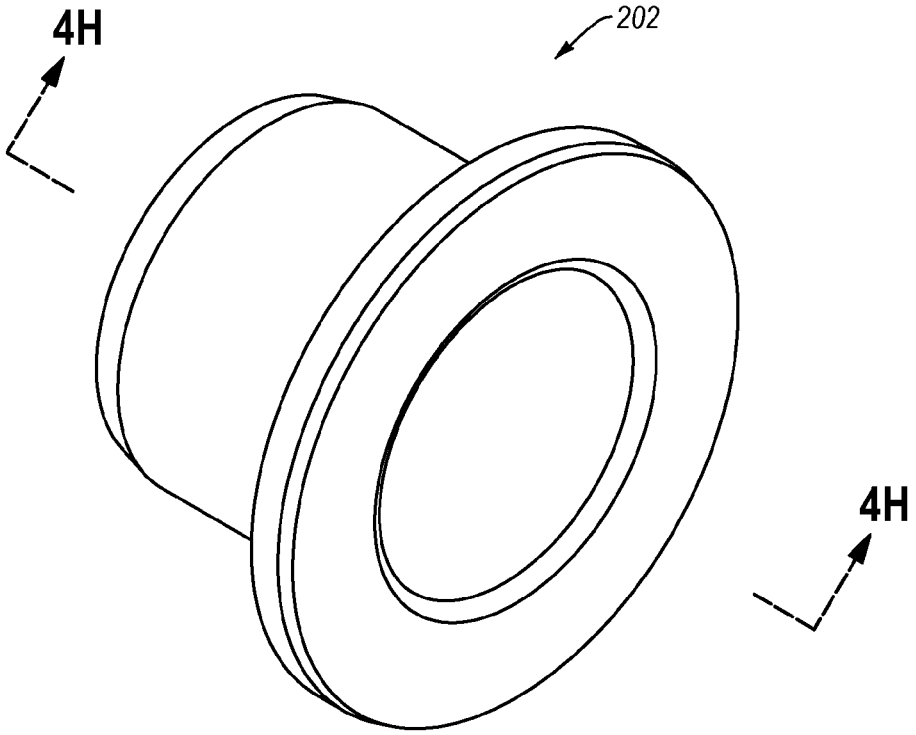
FIG. 4G is a perspective view of an example internal connector structure of the example compression connector of FIGS. 4E and 4F.
Figure 4H:
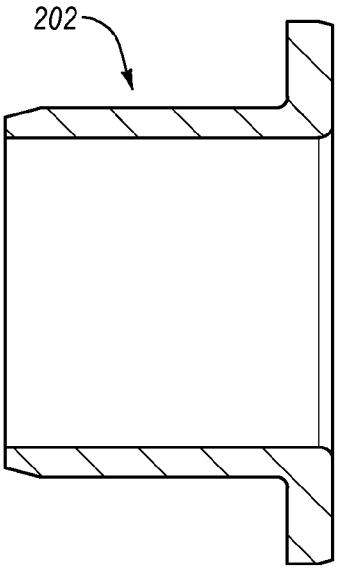
FIG. 4H is a cross-sectional side view of the example internal connector structure of FIG. 4G.
Figure 4I:
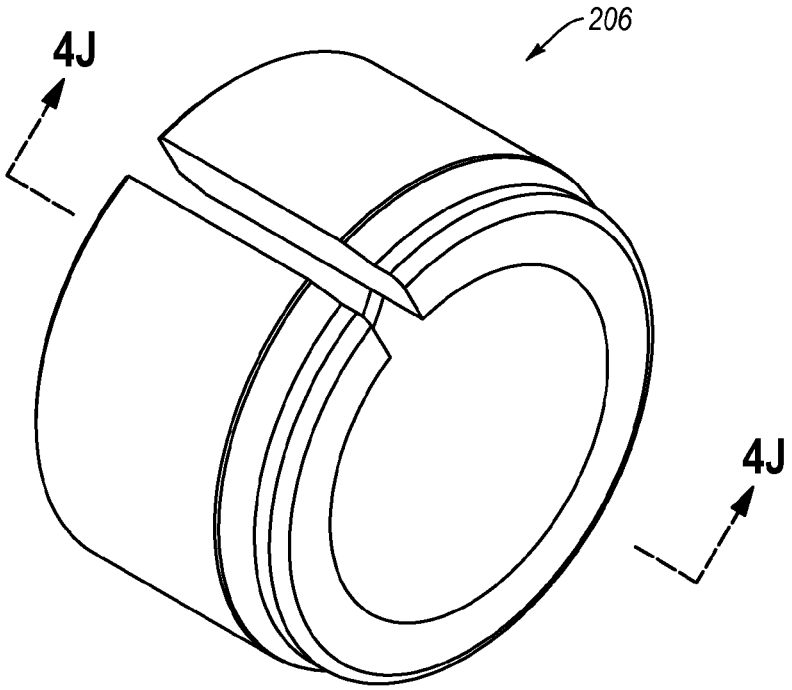
FIG. 4I is a perspective view of an example external connector structure of the example compression connector of FIGS. 4E and 4F.
Figure 4J:
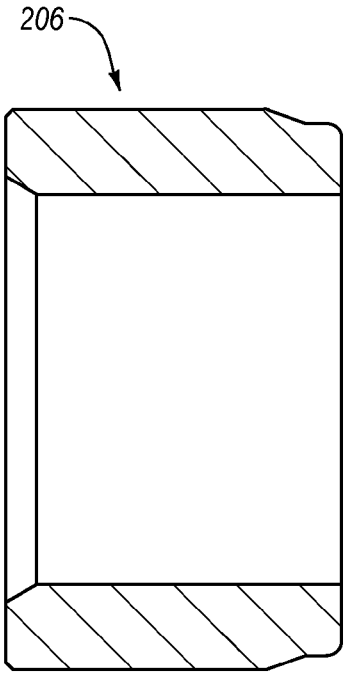
FIG. 4J is a cross-sectional side view of the example external connector structure of FIG. 4I.
Figure 4K:
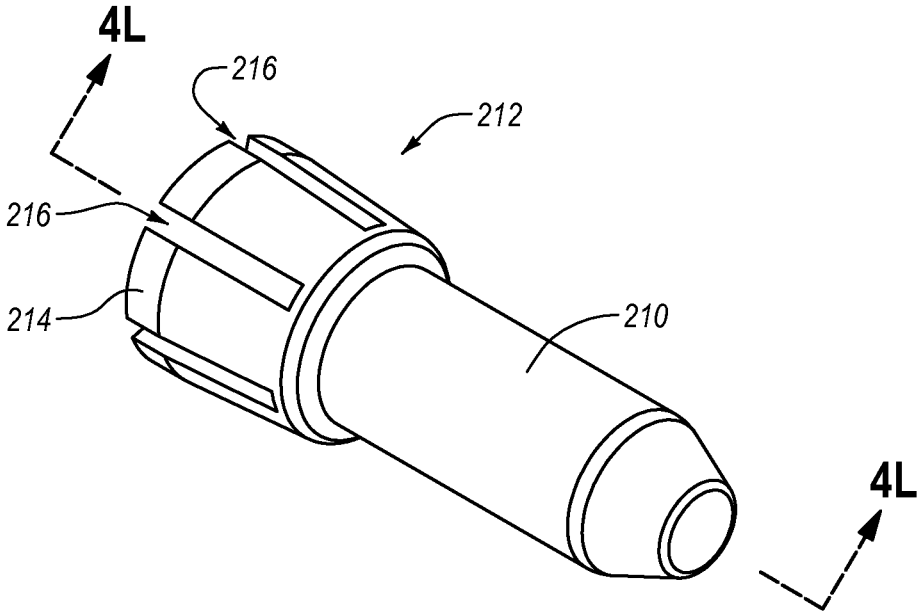
FIG. 4K is a perspective view of an example conductive pin of the example compression connector of FIGS. 4E and 4F.
Figure 4L:
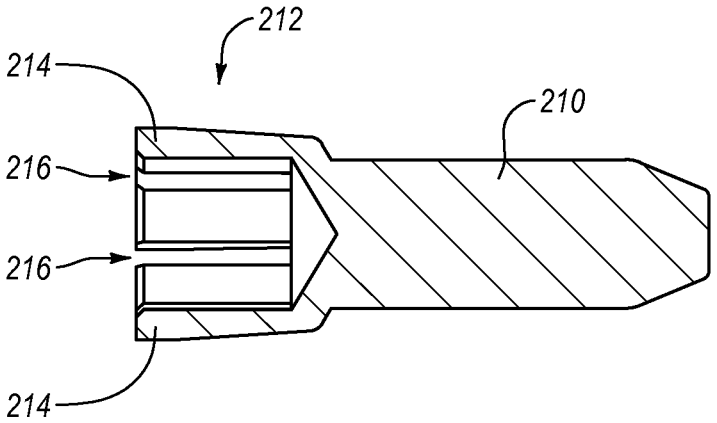
FIG. 4L is a cross-sectional side view of the example conductive pin of FIG. 4K.

With reference to FIGS. 3 and 4F, the method 400 continues with an act 412 in which the external connector structure 206 is clamped around the increased-diameter cylindrical section 116 so as to radially compress the increased-diameter cylindrical section 116 between the external connector structure 206 and the internal connector structure 202. For example, as disclosed in FIGS. 41 and 4J, the external connector structure 206 includes a slot. The slot is configured to narrow or close as the compression connector 200 is moved from an open position (as disclosed in FIG. 4E) to an engaged position (as disclosed in FIG. 4F). As the external connector structure 206 is clamped around the increased-diameter cylindrical section 116, the internal connector structure 202 is employed to prevent the collapse of the increased-diameter cylindrical section 116 of the outer conductor 106 when the external connector structure 206 applies pressure to the outside of the increased-diameter cylindrical section 116. Although the inside surface of the external connector structure 206 is generally cylindrical, it is understood that portions of the inside surface of the external connector structure 206 may be non-cylindrical. For example, the inside surface of the external connector structure 206 may include steps, grooves, or ribs in order achieve mechanical and electrical contact with the increased-diameter cylindrical section 116.

For example, the outside surface of the inserted portion of the internal connector structure 202 may include a rib that corresponds to a cooperating groove included on the inside surface of the external connector structure 206. In this example, the compression of the increased-diameter cylindrical section 116 between the internal connector structure 202 and the external connector structure 206 will cause the rib of the internal connector structure 202 to deform the increased-diameter cylindrical section 116 into the cooperating groove of the external connector structure 206. This can result in improved mechanical and/or electrical contact between the external connector structure 206, the increased-diameter cylindrical section 116, and the internal connector structure 202. In this example, the locations of the rib and the cooperating groove can also be reversed. Further, it is understood that at least portions of the surfaces of the rib and the cooperating groove can be cylindrical surfaces. Also, multiple rib/cooperating groove pairs may be included on the internal connector structure 202 and/or the external connector structure 206. Therefore, the inserted portion of the internal connector structure 202 and the external connector structure 206 are not limited to the configurations disclosed in the figures.

With reference to FIGS. 3 and 4F, the method 400 finishes with an act 414 in which the collet portion 212 of the conductive pin 210 is radially contracted around the inner conductor 102 so as to increase a contact force between the inner conductor 102 and the collet portion 212. As disclosed in FIG. 3, the act 414 can be performed with the act 412 via a single action, such as the single action of moving the compression connector 200 from an open position (as disclosed in FIG. 4E) to an engaged position (as disclosed in FIG. 4F). For example, as disclosed in FIGS. 4K and 4L, the collet portion 212 of the conductive pin 210 includes fingers 214 separated by slots 216. The slots 216 are configured to narrow or close as the compression connector 200 is moved from an open position (as disclosed in FIG. 4E) to an engaged position (as disclosed in FIG. 4F). As the collet portion 212 is axially forced forward within the compression connector 200, the fingers 214 of the collet portion 212 are radially contracted around the inner conductor 102 by narrowing or closing the slots 216 (see FIGS. 4K and 4L) and by radially compressing the inner conductor 102 inside the collet portion 212. This radial contraction of the conductive pin 210 results in an increased contact force between the conductive pin 210 and the inner conductor 102, and can also result in some deformation of the inner conductor 102 and/or the fingers 214. As used herein, the term "contact force" is the combination of the net friction and the net normal force between the surfaces of two components. This contracting configuration increases the reliability of the mechanical and electrical contact between the conductive pin 210 and the inner conductor 102. The act 414 thus terminates the coaxial cable 100 by permanently affixing the connector 200 to the terminal end of the coaxial cable 100, as disclosed in the right side of FIG. 1A.

Additional details of the structure and function of the example connector 200 are disclosed in co-pending U.S. patent application Ser. No. 12/753,735, titled "COAXIAL CABLE COMPRESSION CONNECTORS," filed Apr. 2, 2010 and incorporated herein by reference in its entirety.

With reference to FIGS. 4E-4J, the internal connector structure 202 and the external connector structure 206 are both formed from metal, which makes the internal connector structure 202 and the external connector structure 206 relatively sturdy. As disclosed in FIG. 4F, the thickness of the metal inserted portion of the internal connector structure 202 is greater than the difference between the inside diameter of the peaks of the corrugated outer conductor and the inside diameter of the valleys of the corrugated outer conductor 106. It is understood, however, that the thickness of the metal inserted portion of the internal connector structure 202 could be greater than or less than the thickness disclosed in FIG. 4F.

It is understood that one of the internal connector structure 202 and the external connector structure 206 can alternatively be formed from a non-metal material such as polyetherimide (PEI) or polycarbonate, or from a metal/non-metal composite material such as a selectively metal-plated PEI or polycarbonate material. A selectively metal-plated internal connector structure 202 or external connector structure 206 may be metal-plated at contact surfaces where the internal connector structure 202 or the external connector structure 206 makes contact with another component of the compression connector 200. Further, bridge plating, such as one or more metal traces, can be included between these metal-plated contact surfaces in order to ensure electrical continuity between the contact surfaces.

The increased-diameter cylindrical section 116 of the outer conductor 106 enables the inserted portion of the internal connector structure 202 to be relatively thick and to be formed from a material with a relatively high dielectric constant and still maintain favorable impedance characteristics. Also disclosed in FIG. 4F, the metal inserted portion of the internal connector structure 202 has an inside diameter that is less than the inside diameter of the valleys of the corrugated outer conductor 106. It is understood, however, that the inside diameter of the metal inserted portion of the internal connector structure 202 could be greater than or less than the inside diameter disclosed in FIG. 4F. For example, the metal inserted portion of the internal connector structure 202 can have an inside diameter that is about equal to an average diameter of the valleys and the peaks of the corrugated outer conductor 106.

Once inserted, the internal connector structure 202 replaces the material from which the insulating layer 104 is formed in the cored-out section 114. This replacement changes the dielectric constant of the material positioned between the inner conductor 102 and the outer conductor 106 in the cored-out section 114. Since the impedance of the coaxial cable 100 is a function of the diameters of the inner and outer conductors 102 and 106 and the dielectric constant of the insulating layer 104, in isolation this change in the dielectric constant would alter the impedance of the cored-out section 114 of the coaxial cable 100. Where the internal connector structure 202 is formed from a material that has a significantly different dielectric constant from the dielectric constant of the insulating layer 104, this change in the dielectric constant would, in isolation, significantly alter the impedance of the cored-out section 114 of the coaxial cable 100.

However, the increase of the diameter of the outer conductor 106 of the increased-diameter cylindrical section 116 at the act 408 is configured to compensate for the difference in the dielectric constant between the removed insulating layer 104 and the inserted internal connector structure 202 in the cored-out section 114. Accordingly, the increase of the diameter of the outer conductor 106 in the increased-diameter cylindrical section 116 at the act 408 enables the impedance of the cored-out section 114 to remain about equal to the impedance of the remainder of the coaxial cable 100, thus reducing internal reflections and resulting signal loss associated with inconsistent impedance.

In general, the impedance z of the coaxial cable 100 can be determined using Equation (1):

$$z = \left(\frac{138}{\sqrt{\varepsilon}}\right) * \log\left(\frac{\phi_{OUTER}}{\phi_{INNER}}\right) \quad (1)$$

where ∈ is the dielectric constant of the material between the inner and outer conductors 102 and 106, $\phi_{OUTER}$ is the effective inside diameter of the corrugated outer conductor 106, and $\phi_{INNER}$ is the outside diameter of the inner conductor 102. However, once the insulating layer 104 is removed from the cored-out section 114 of the coaxial cable 100 and the internal connector structure 202 is inserted into the cored-out section 114, the internal connector structure 202 effectively becomes an extension of the metal outer conductor 106 in the cored-out section 114 of the coaxial cable 100.

In the example method 400 disclosed herein, the impedance z of the example coaxial cable 100 should be maintained at 50 Ohms. Before termination, the impedance z of the coaxial cable is formed at 50 Ohms by forming the example coaxial cable 100 with the following characteristics:

∈=1.100;

$\phi_{OUTER}$=0.458 inches;

$\phi_{INNER}$=0.191 inches; and z=50 Ohms

During the method 400 for terminating the coaxial cable 100, however, the inside diameter of the cored-out section 114 of the outer conductor 106 $\phi_{OUTER}$ of 0.458 inches is effectively replaced by the inside diameter of the internal connector structure 202 of 0.440 inches in order to maintain the impedance z of the cored-out section 114 of the coaxial cable 100 at 50 Ohms, with the following characteristics:

∈=1.000;

$\phi_{OUTER}$ (the inside diameter of the internal connector structure 202)=0.440 inches;

$\phi_{INNER}$=0.191 inches; and z=50 Ohms

Thus, the increase of the diameter of the outer conductor 106 enables the internal connector structure 202 to be formed from metal and effectively replace the inside diameter of the cored-out section 114 of the outer conductor 106 $\phi_{OUTER}$. Further, the increase of the diameter of the outer conductor 106 also enables the internal connector structure 202 to alternatively be formed from a non-metal material having a dielectric constant that does not closely match the dielectric constant of the material from which the insulating layer 104 is formed. For example, the diameter of the increased-diameter cylindrical section 116 can be increased to be greater than the outer diameter of the peaks of the outer conductor 106 in order to enable the internal connector structure 202 to be formed relatively thickly from a material having a relatively high dielectric constant, such as PEI or polycarbonate, for example.

As disclosed in FIGS. 4D-4F, the particular increased diameter of the increased-diameter cylindrical section 116 correlates to the shape and type of material from which the internal connector structure 202 is formed. It is understood that any change to the shape and/or material of the internal connector structure 202 may require a corresponding change to the diameter of the increased-diameter cylindrical section 116.

As disclosed in FIG. 4F, the increased diameter of the increased-diameter cylindrical section 116 also facilitates an increase in the thickness of the internal connector structure 202. In addition, as discussed above, the increased diameter of the increased-diameter cylindrical section 116 also enables the internal connector structure 202 to be formed from a relatively sturdy material such as metal. The relatively sturdy internal connector structure 202, in combination with the cylindrical configuration of the increased-diameter cylindrical section 116, enables a relative increase in the amount of radial force that can be directed inward on the increased-diameter cylindrical section 116 without collapsing the increased-diameter cylindrical section 116 or the internal connector structure 202. Further, the cylindrical configuration of the increased-diameter cylindrical section 116 enables the inwardly-directed force to have primarily a radial component and have substantially no axial component, thus removing any dependency on a continuing axial force which can tend to decrease over time under extreme weather and temperature conditions. It is understood, however, that in addition to the primarily radial component directed to the increased-diameter cylindrical section 116, the example compression connector 200 may additionally include one or more structures that exert an inwardly-directed force having an axial component on another section or sections of the outer conductor 106.

This relative increase in the amount of force that can be directed inward on the increased-diameter cylindrical section 116 increases the security of the mechanical and electrical contacts between the internal connector structure 202, the increased-diameter cylindrical section 116, and the external connector structure 206. Further, the contracting configuration of the conductive pin 210 increases the security of the mechanical and electrical contacts between the conductive pin 210 and the inner conductor 102. Even in applications where these mechanical and electrical contacts between the connector 200 and the coaxial cable 100 are subject to stress due to high wind, precipitation, extreme temperature fluctuations, and vibration, the relative increase in the amount of force that can be directed inward on the increased-diameter cylindrical section 116, combined with the contracting configuration of the conductive pin 210, tend to maintain these mechanical and electrical contacts with relatively small degradation over time. These mechanical and electrical contacts thus reduce, for example, micro arcing or corona discharge between surfaces, which reduces the PIM levels and associated creation of interfering RF signals that emanate from the example connector 200.

Figure 5A:
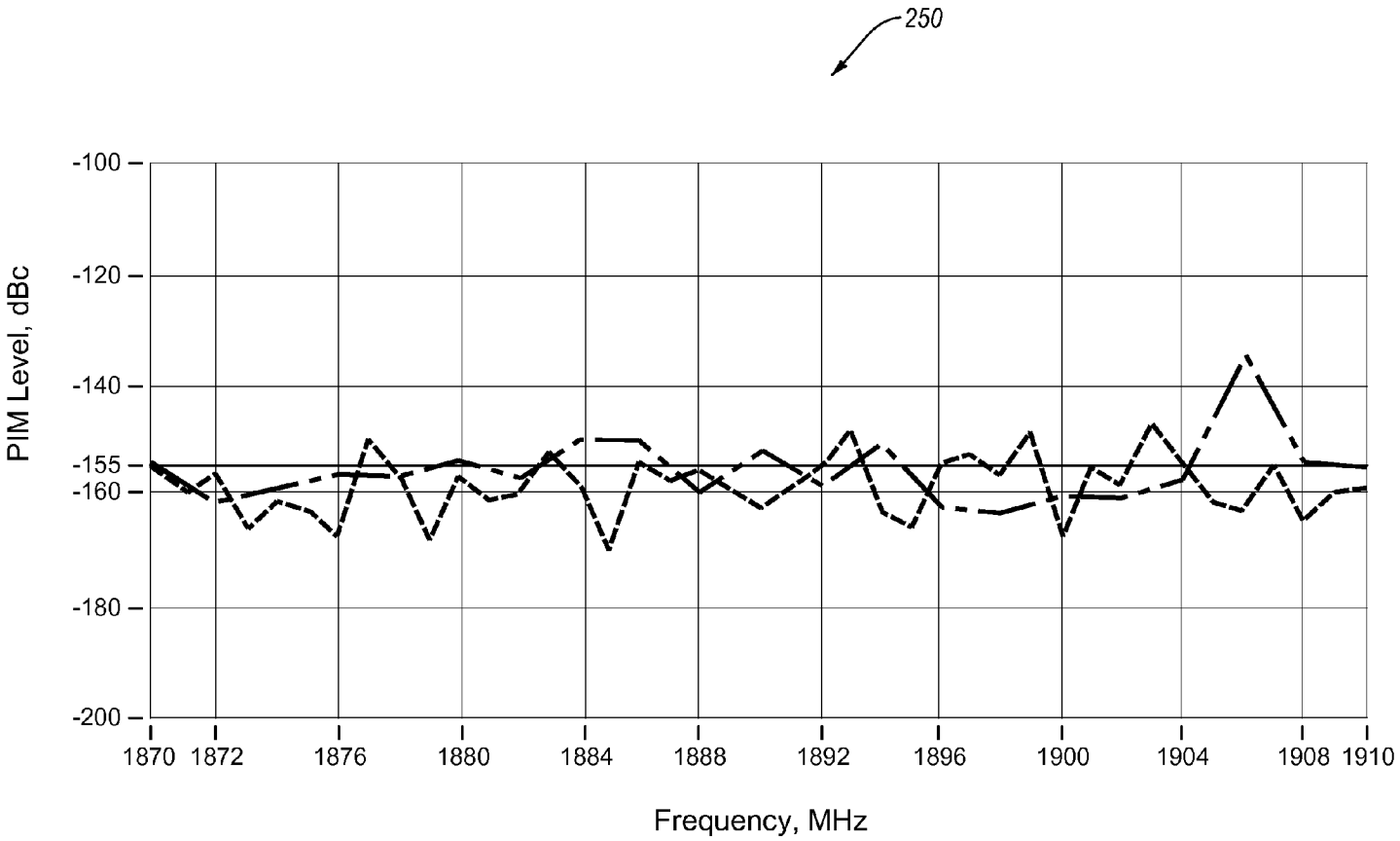
Fig. 5A (Prior Art)
FIG. 5A is a chart of passive intermodulation (PIM) in a prior art coaxial cable compression connector.

FIG. 5A discloses a chart 250 showing the results of PIM testing performed on a coaxial cable that was terminated using a prior art compression connector. The PIM testing that produced the results in the chart 250 was performed under dynamic conditions with impulses and vibrations applied to the prior art compression connector during the testing. As disclosed in the chart 250, the PIM levels of the prior art compression connector were measured on signals F1 and F2 to significantly vary across frequencies 1870-1910 MHz. In addition, the PIM levels of the prior art compression connector frequently exceeded a minimum acceptable industry standard of −155 dBc.

Figure 5B:
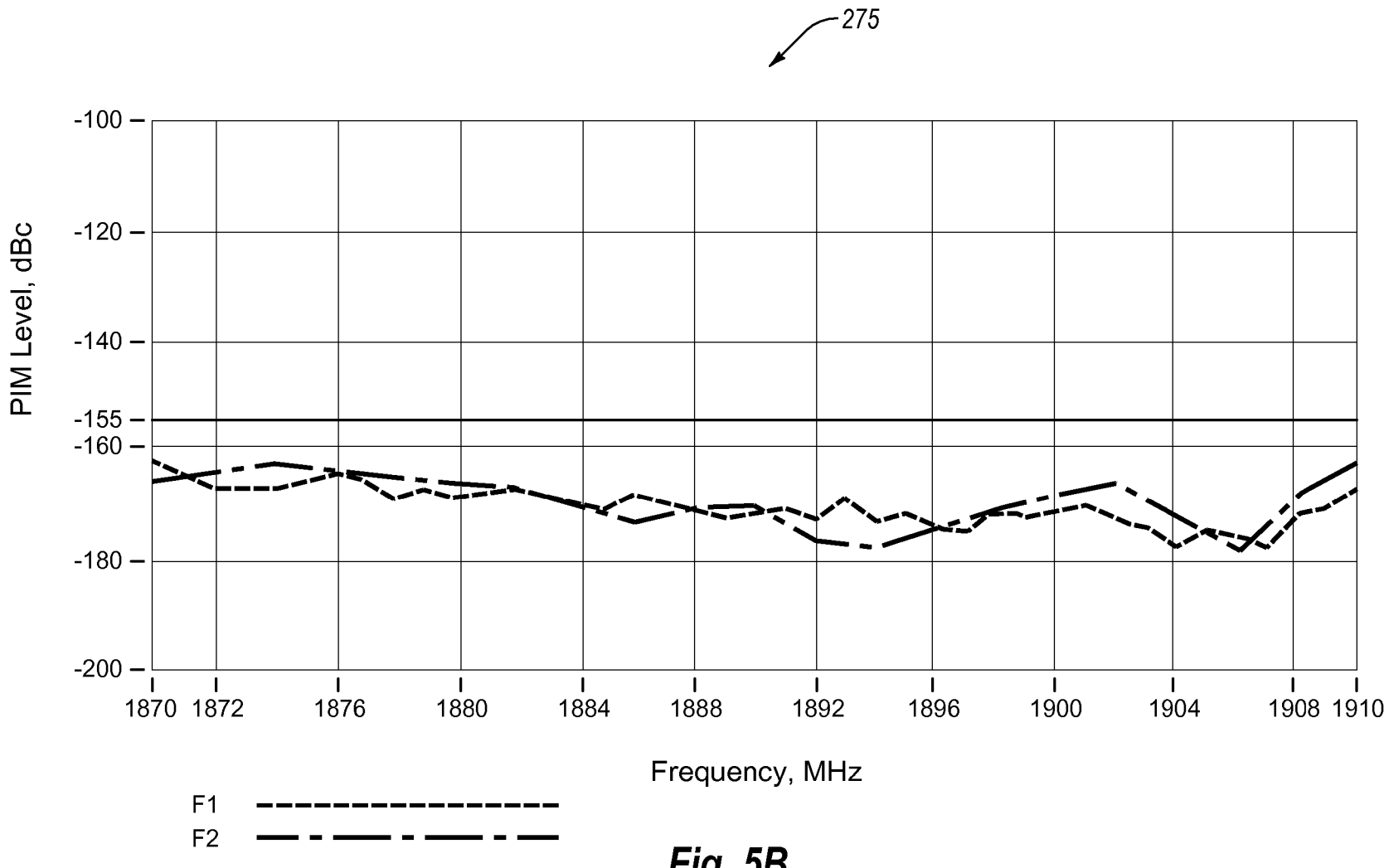
FIG. 5B is a chart of PIM in the example compression connector of FIG. 4F.

In contrast, FIG. 5B discloses a chart 275 showing the results of PIM testing performed on the coaxial cable 100 that was terminated using the example compression connector 200. The PIM testing that produced the results in the chart 275 was also performed under dynamic conditions with impulses and vibrations applied to the example compression connector 200 during the testing. As disclosed in the chart 275, the PIM levels of the example compression 200 were measured on signals F1 and F2 to vary significantly less across frequencies 1870-1910 MHz. Further, the PIM levels of the example compression connector 200 remained well below the minimum acceptable industry standard of −155 dBc. These superior PIM levels of the example compression connector 200 are due at least in part to the cylindrical configurations of the increased-diameter cylindrical section 116, the cylindrical outside surface of the internal connector structure 202, the cylindrical inside surface of the external connector structure 206, as well as the contracting configuration of the conductive pin 210.

It is noted that although the PIM levels achieved using the prior art compression connector generally satisfy the minimum acceptable industry standard of −140 dBc (except at 1906 MHz for the signal F2) required in the 2G and 3G wireless industries for cellular communication towers. However, the PIM levels achieved using the prior art compression connector fall below the minimum acceptable industry standard of −155 dBc that is currently required in the 4G wireless industry for cellular communication towers. Compression connectors having PIM levels above this minimum acceptable standard of −155 dBc result in interfering RF signals that disrupt communication between sensitive receiver and transmitter equipment on the tower and lower-powered cellular devices in 4G systems. Advantageously, the relatively low PIM levels achieved using the example compression connector 200 surpass the minimum acceptable level of −155 dBc, thus reducing these interfering RF signals. Accordingly, the example field-installable compression connector 200 enables coaxial cable technicians to perform terminations of coaxial cable in the field that have sufficiently low levels of PIM to enable reliable 4G wireless communication. Advantageously, the example field-installable compression connector 200 exhibits impedance matching and PIM characteristics that match or exceed the corresponding characteristics of less convenient factory-installed soldered or welded connectors on pre-fabricated jumper cables.

In addition, it is noted that a single design of the example compression connector 200 can be field-installed on various manufacturers' coaxial cables despite slight differences in the cable dimensions between manufacturers. For example, even though each manufacturer's ½" series corrugated coaxial cable has a slightly different sinusoidal period length, valley diameter, and peak diameter in the corrugated outer conductor, the preparation of these disparate corrugated outer conductors to have a substantially identical increased-diameter cylindrical section 116, as disclosed in the method 400 herein, enables each of these disparate cables to be terminated using a single compression connector 200. Therefore, the example method 400 and the design of the example compression connector 200 avoid the hassle of having to employ a different connector design for each different manufacturer's corrugated coaxial cable.

V. Second Embodiment of the Method for Terminating a Coaxial Cable

Figure 6A:
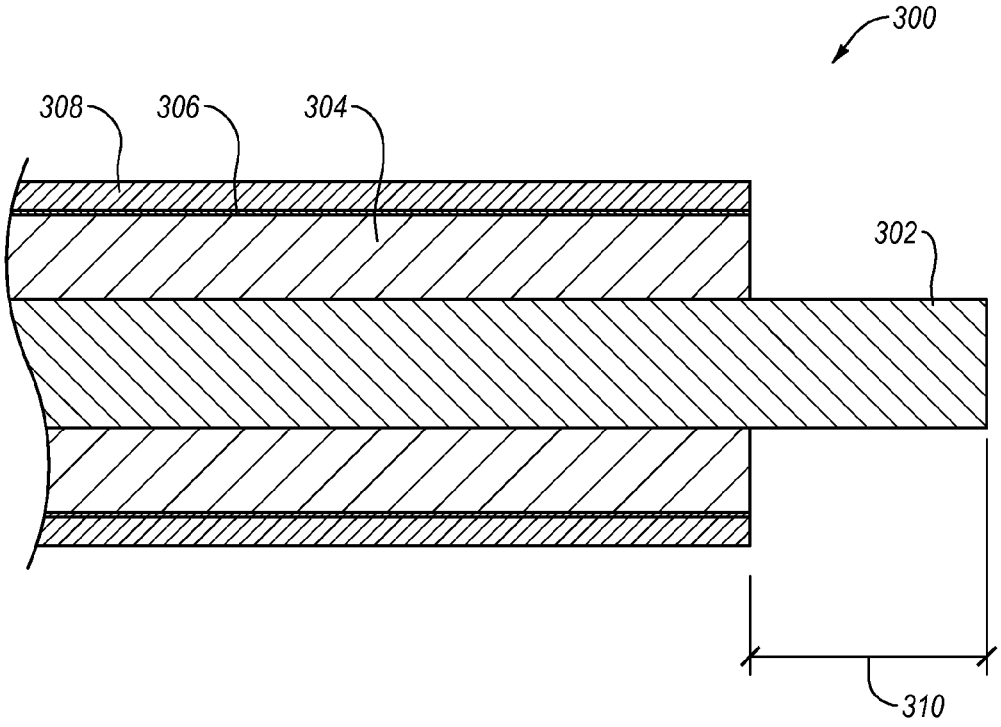
FIGS. 6A-6D are various cross-sectional side views of a terminal end of the example smooth-walled coaxial cable of FIG. 2A during various stages of the example method of FIG. 3.

With reference to FIGS. 3 and 6A-6F, a second example embodiment of the method 400 in terminating the example smooth-walled coaxial cable 300 will now be disclosed. With reference to FIGS. 3 and 6A, the method 400 begins with the act 402 in which the jacket 308, smooth-walled outer conductor 306, and insulating layer 304 is stripped from a first section 310 of the coaxial cable 300. This stripping of the jacket 308, corrugated outer conductor 306, and insulating layer 304 can be accomplished as discussed above in connection with FIG. 4A.

Figure 6B:
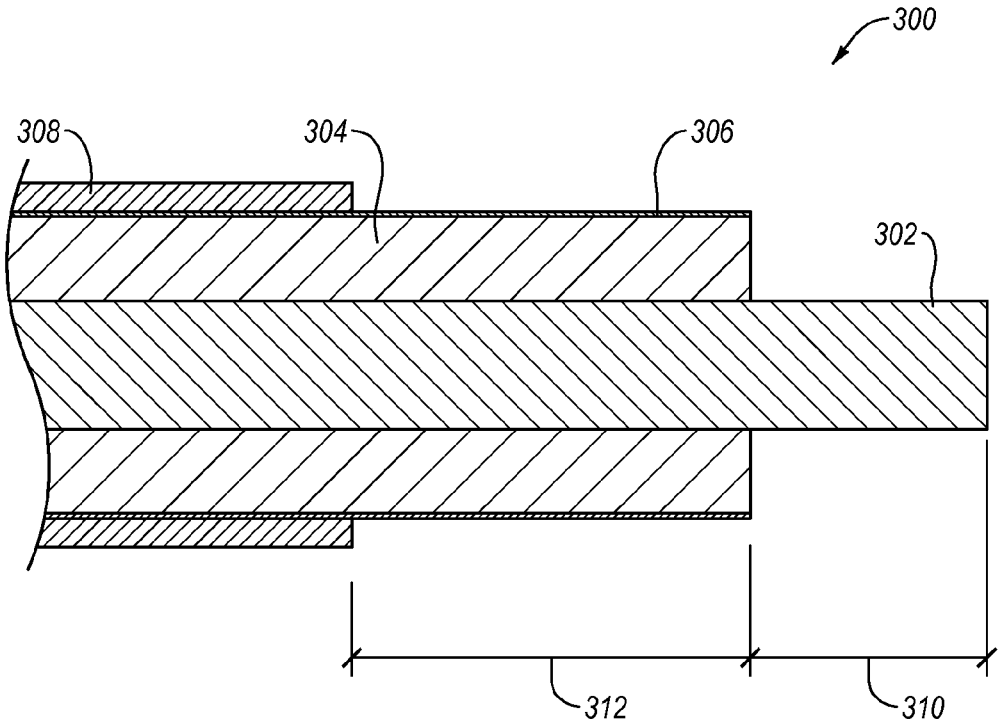

With reference to FIGS. 3 and 6B, the method 400 continues with the act 404 in which the jacket 308 is stripped from a second section 312 of the coaxial cable 300. This stripping of the jacket 308 can be accomplished as discussed above in connection with FIG. 4B.

Figure 6C:
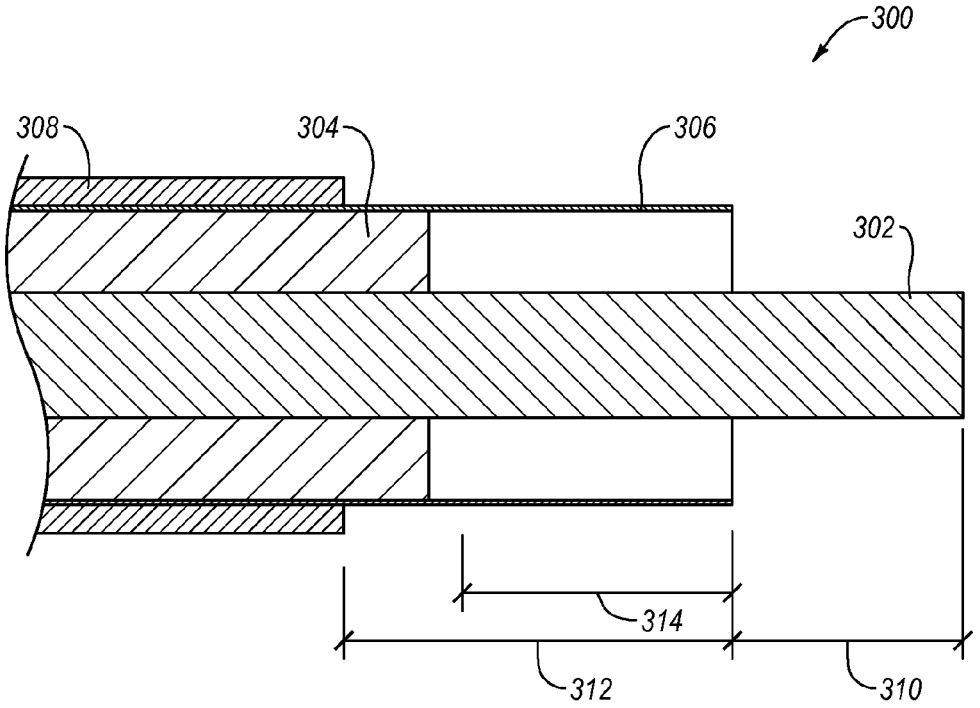

With reference to FIGS. 3 and 6C, the method 400 continues with the act 406 in which a section 314 of the insulating layer 304 is cored out. This coring-out of the insulating layer 304 can be accomplished as discussed above in connection with FIG. 4C.

Figure 6D:
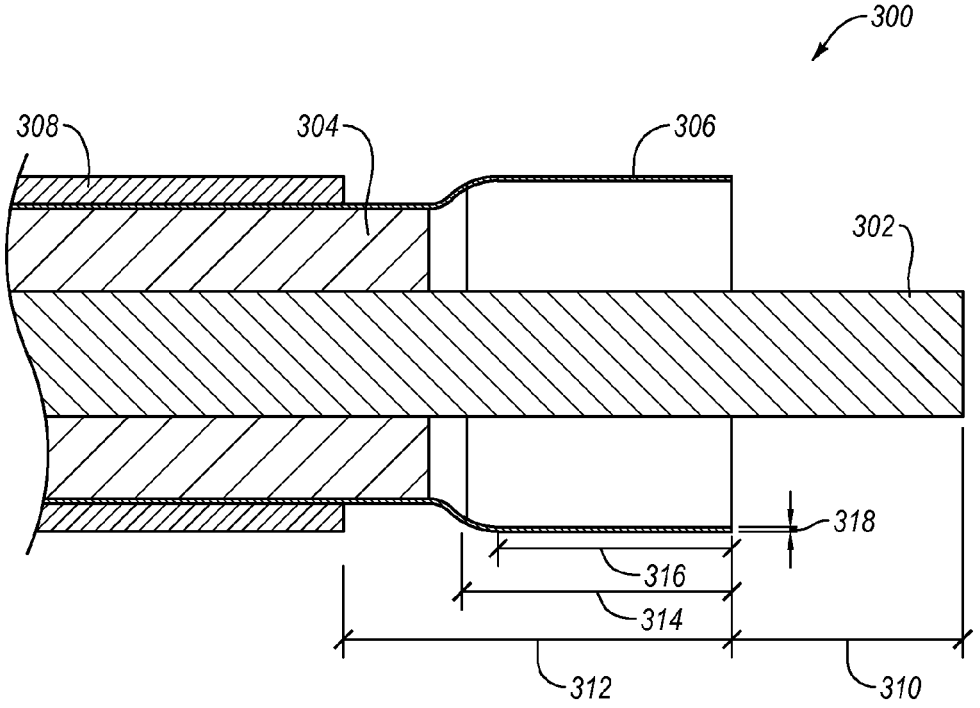

With reference to FIGS. 3 and 6D, the method 400 continues with the act 408 in which the diameter of a portion of the smooth-walled outer conductor 306 that surrounds the cored-out section 314 is increased so as to create an increased-diameter cylindrical section 316 of the outer conductor 306. This increasing of the diameter of the smooth-walled outer conductor 306 can be accomplished using any of the tools discussed above in connection with FIG. 4D, for example. The increased-diameter cylindrical section 316 is similar in shape and dimensions to the increased-diameter cylindrical section 116 of FIG. 4D.

Figure 6E:
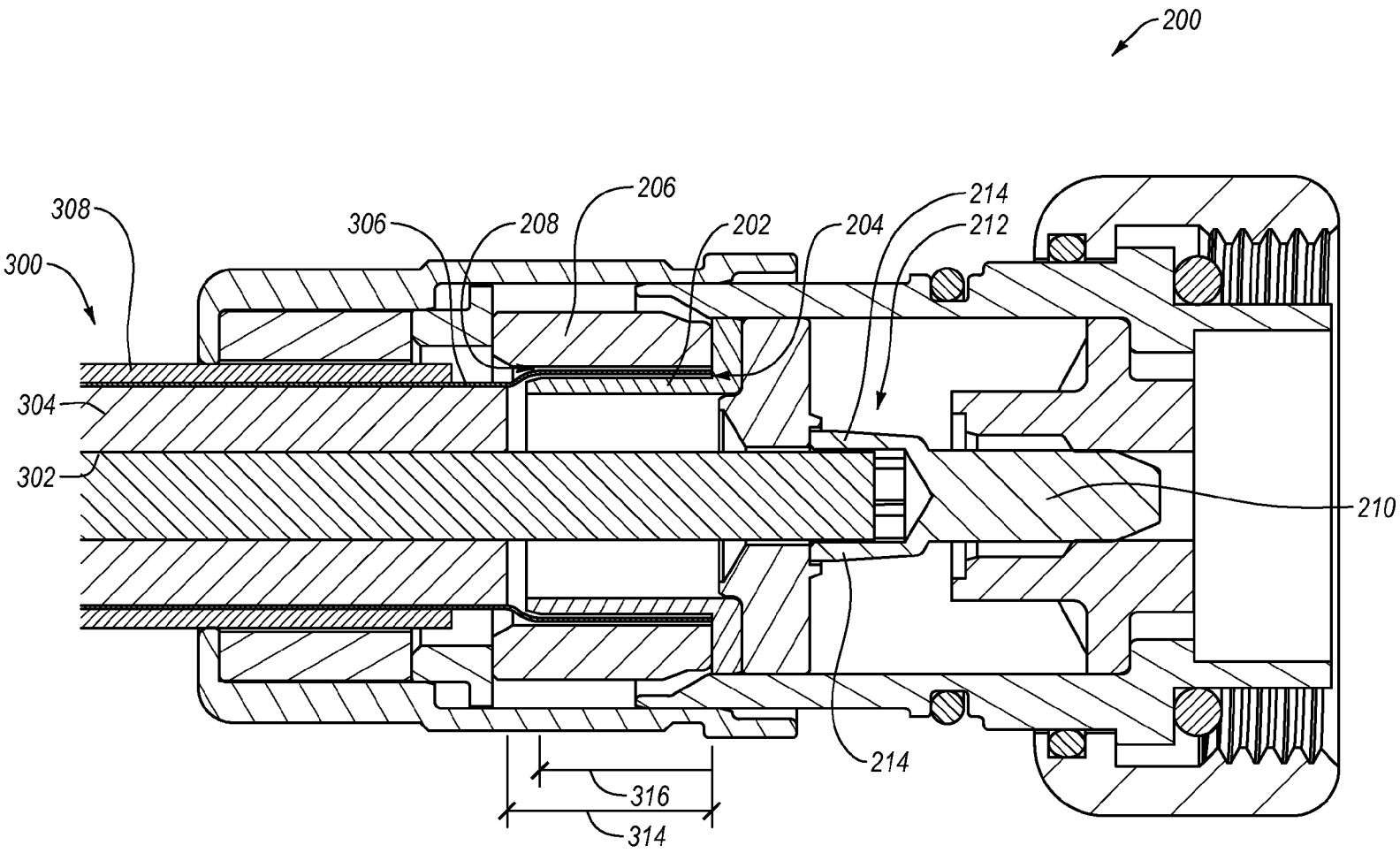
FIG. 6E is a cross-sectional side view of the terminal end of the example smooth-walled coaxial cable of FIG. 6D after having been inserted into the example compression connector of FIG. 2A, with the example compression connector being in an open position.

With reference to FIGS. 3 and 6E, the method 400 continues with the act 410 in which at least a portion of the internal connector structure 202 is inserted into the cored-out section 314 so as to be surrounded by the increased-diameter cylindrical section 316 of the outer conductor 306, leaving the gap 204 between the internal connector structure 202 and the increased-diameter cylindrical section 316. Further, once inserted into the connector 200, the increased-diameter cylindrical section 316 is surrounded by the external connector structure 206, leaving the gap 208 between the increased-diameter cylindrical section 316 and the external connector structure 206.

Figure 6F:
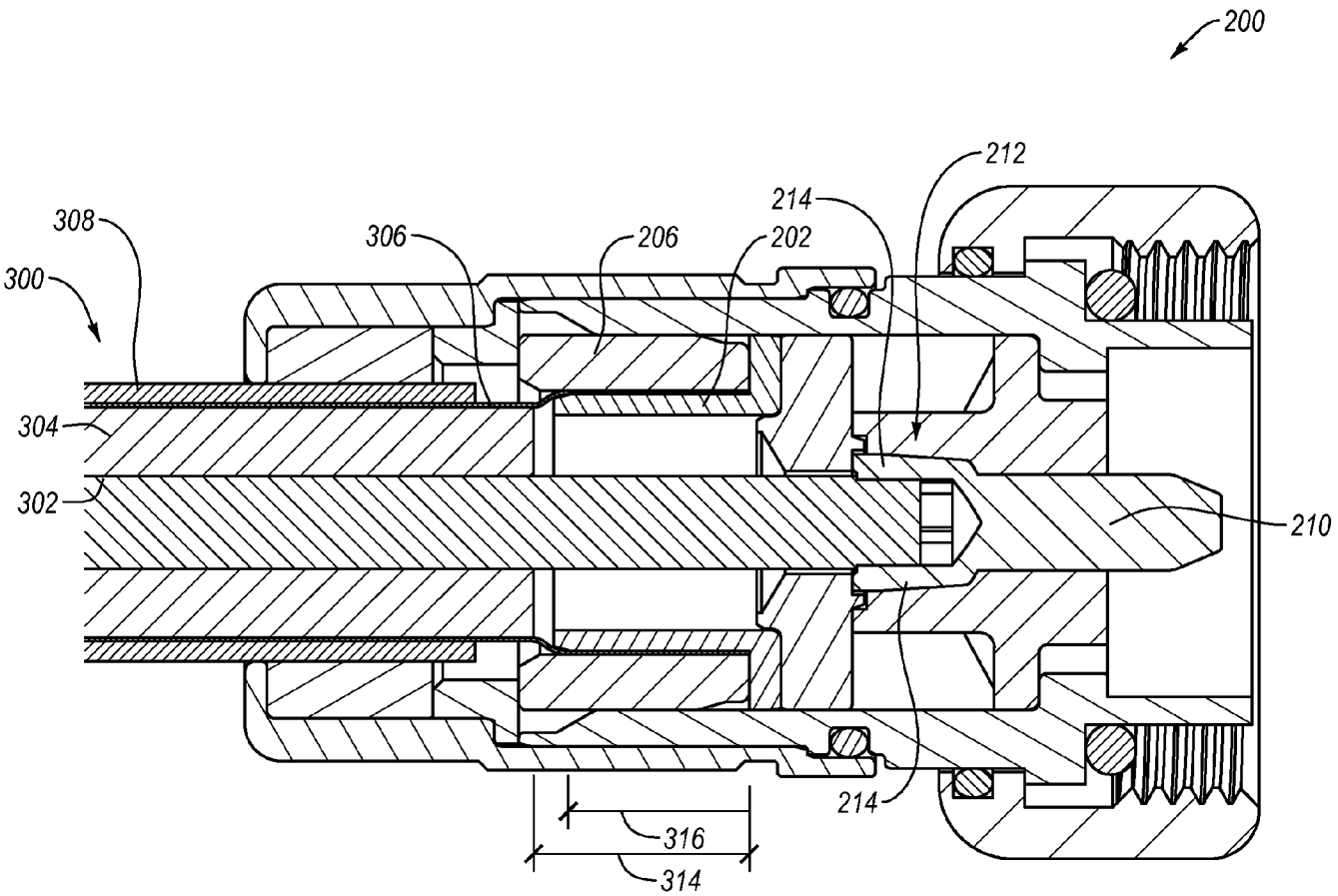
FIG. 6F is a cross-sectional side view of the terminal end of the example smooth-walled coaxial cable of FIG. 6D after having been inserted into the example compression connector of FIG. 2A, with the example compression connector being in an engaged position.

With reference to FIGS. 3 and 6F, the method 400 continues with an act 412 in which the external connector structure 206 is clamped around the increased-diameter cylindrical section 316 so as to radially compress the increased-diameter cylindrical section 316 between the external connector structure 206 and the internal connector structure 202.

With reference to FIGS. 3 and 6F, the method 400 finishes with an act 414 in which the collet portion 212 of the conductive pin 210 is radially contracted around the inner conductor 302 so as to increase a contact force between the inner conductor 302 and the collet portion 212. This contracting configuration increases the reliability of the mechanical and electrical contact between the conductive pin 210 and the inner conductor 302. The act 414 thus terminates the coaxial cable 300 by permanently affixing the connector 200 to the terminal end of the coaxial cable 300, as disclosed in the right side of FIG. 2A.

As disclosed in FIG. 6F, the thickness of the metal inserted portion of the internal connector structure 202 is greater than the difference between the inside diameter of the increased-diameter cylindrical section 316 and the inside diameter of the remainder of the smooth-walled outer conductor 306. It is understood, however, that the thickness of the metal inserted portion of the internal connector structure 202 could be greater than or less than the thickness disclosed in FIG. 6F.

Also disclosed in FIG. 6F, the metal inserted portion of the internal connector structure 202 has an inside diameter that is less than the inside diameter of the smooth-walled outer conductor 306 in order to compensate for the removal of insulating layer 304 in the cored-out section 314. It is understood, however, that the inside diameter of the metal inserted portion of the internal connector structure 202 could be greater than or less than the inside diameter disclosed in FIG. 6F.

As noted above in connection with the first example embodiment of the method 400, the termination of the smooth-walled coaxial cable 300 using the example method 400 enables the impedance of the cored-out section 314 to remain about equal to the impedance of the remainder of the coaxial cable 300, thus reducing internal reflections and resulting signal loss associated with inconsistent impedance. Further, the termination of the smooth-walled coaxial cable 300 using the example method 400 enables improved mechanical and electrical contacts between the internal connector structure 202, the increased-diameter cylindrical section 316, and the external connector structure 206, as well as between the inner conductor 302 and the conductive pin 210, which reduces the PIM levels and associated creation of interfering RF signals that emanate from the example connector 200.

VI. Second Example Compression Connector

Figure 7A:
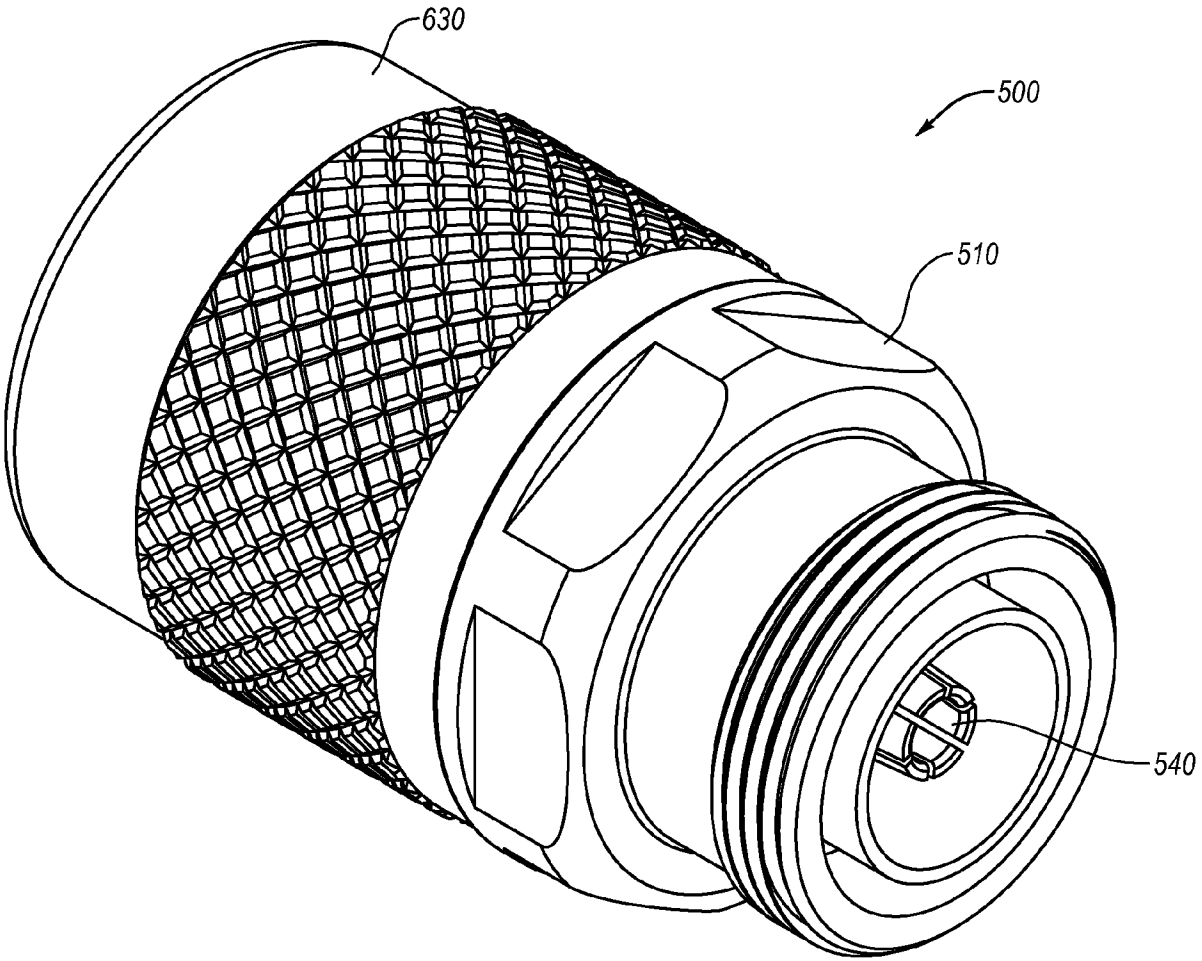
FIG. 7A is a perspective view of another example compression connector.
Figure 7B:
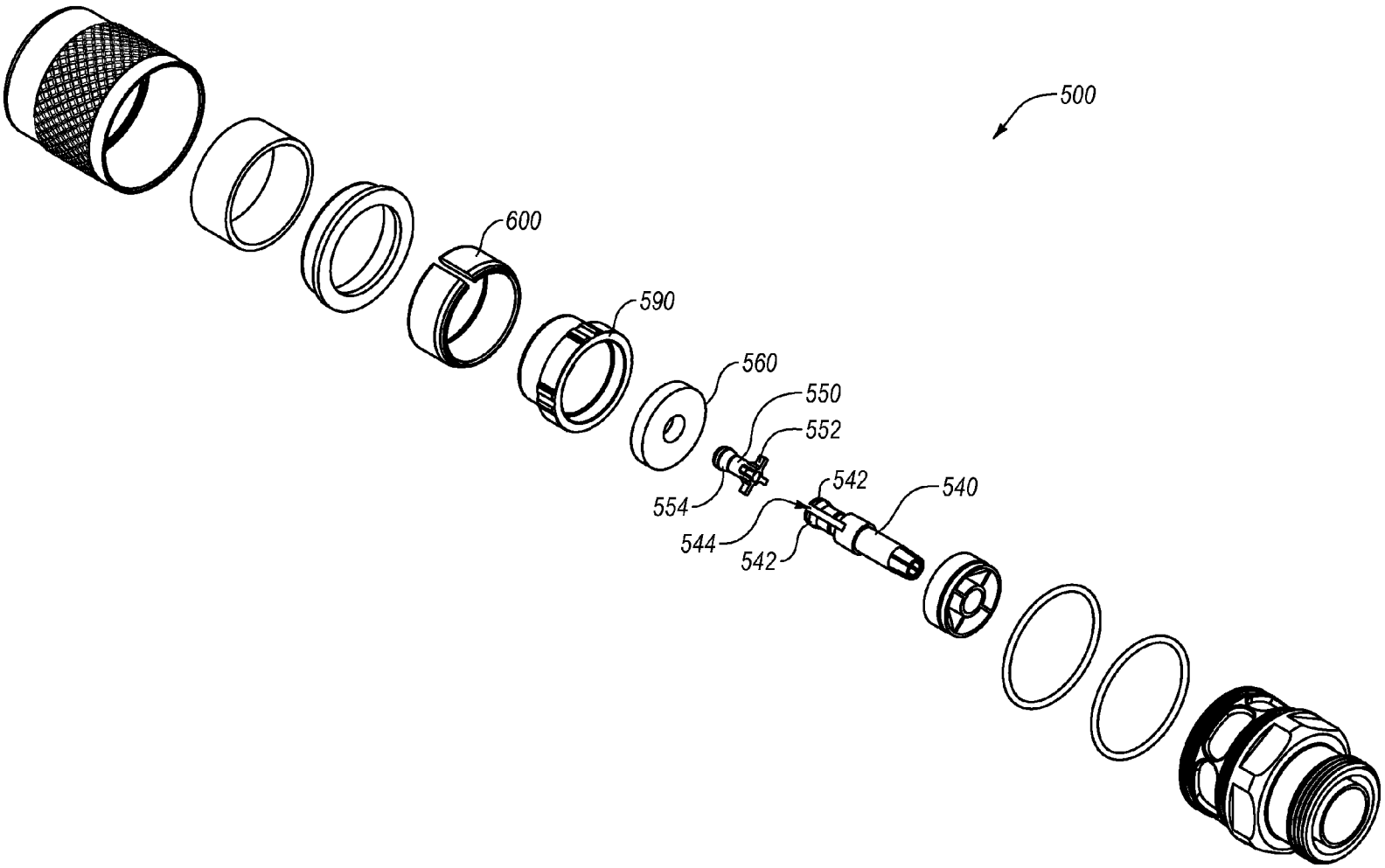
FIG. 7B is an exploded view of the example compression connector of FIG. 7A.

With reference now to FIGS. 7A and 7B, a second example compression connector 500 is disclosed. The example compression connector 500 is configured to terminate either smooth-walled or corrugated 50 Ohm ⅞" series coaxial cable. Further, although the example compression connector 500 is disclosed in FIG. 7A as a female compression connector, it is understood that the compression connector 500 can instead be configured as a male compression connector (not shown).

As disclosed in FIGS. 7A and 7B, the example compression connector 500 includes a conductive pin 540, a guide 550, an insulator 560, an internal connector structure 590, and an external connector structure 600. The internal connector structure 590 and the external connector structure 600 function similarly to the internal connector structure 202 and the external connector structure 206, respectively. The conductive pin 540, guide 550, and insulator 560 function similarly to the pin 14, guide 15, and insulator 16, respectively, disclosed in U.S. Pat. No. 7,527,512, titled "CABLE CONNECTOR EXPANDING CONTACT," which issued May 5, 2009 and is incorporated herein by reference in its entirety.

As disclosed in FIG. 7B, the conductive pin 540 includes a plurality of fingers 542 separated by a plurality of slots 544. The guide 550 includes a plurality of corresponding tabs 552 that correspond to the plurality of slots 544. Each finger 542 includes a ramped portion 546 (see FIG. 7C) on an underside of the finger 542 which is configured to interact with a ramped portion 554 of the guide 550.

VII. Third Embodiment of the Method for Terminating a Coaxial Cable

Figure 7C:
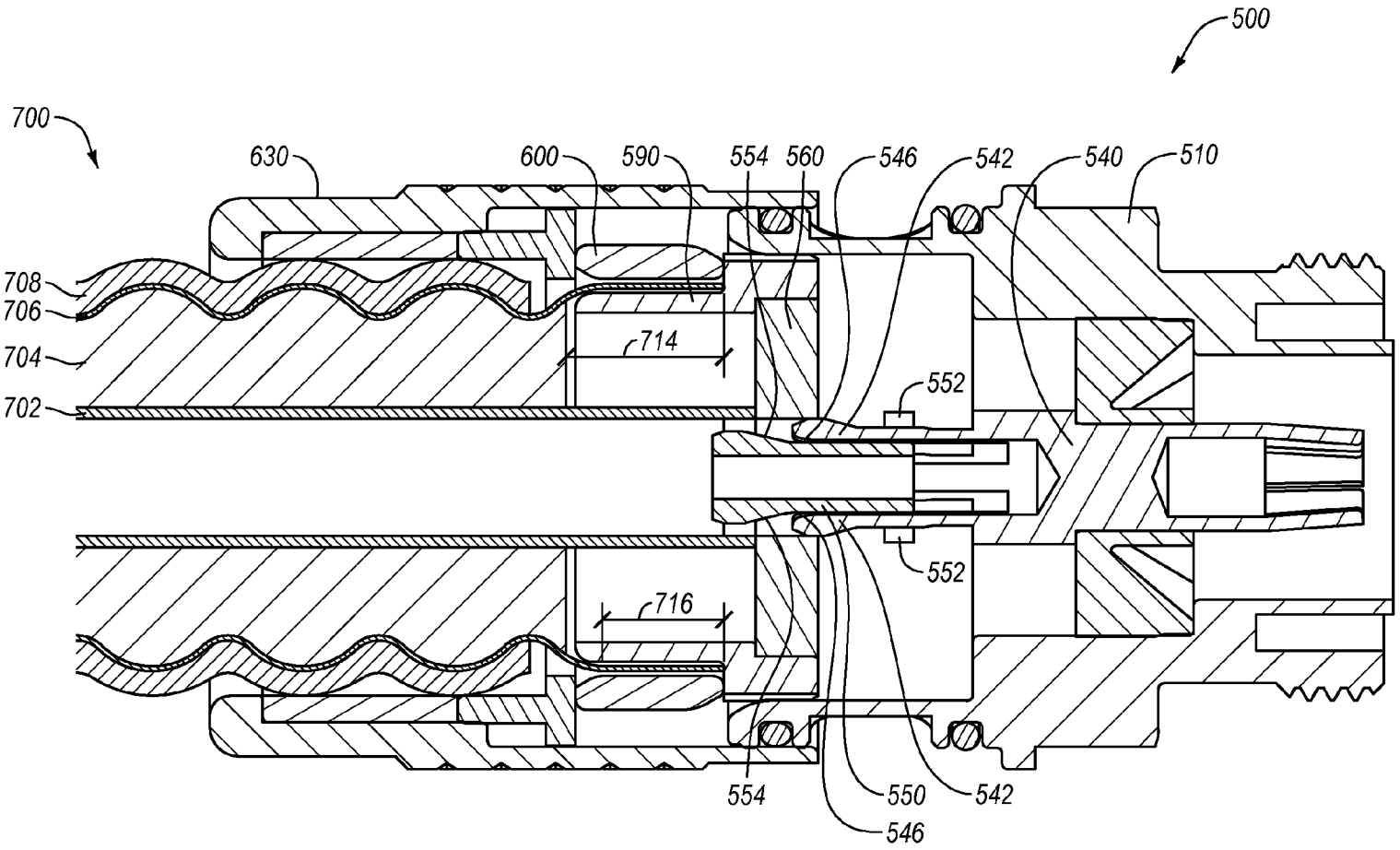
FIG. 7C is a cross-sectional side view of the example compression connector of FIG. 7A after having a terminal end of an example corrugated coaxial cable inserted into the example compression connector, with the example compression connector being in an open position.
Figure 7D:
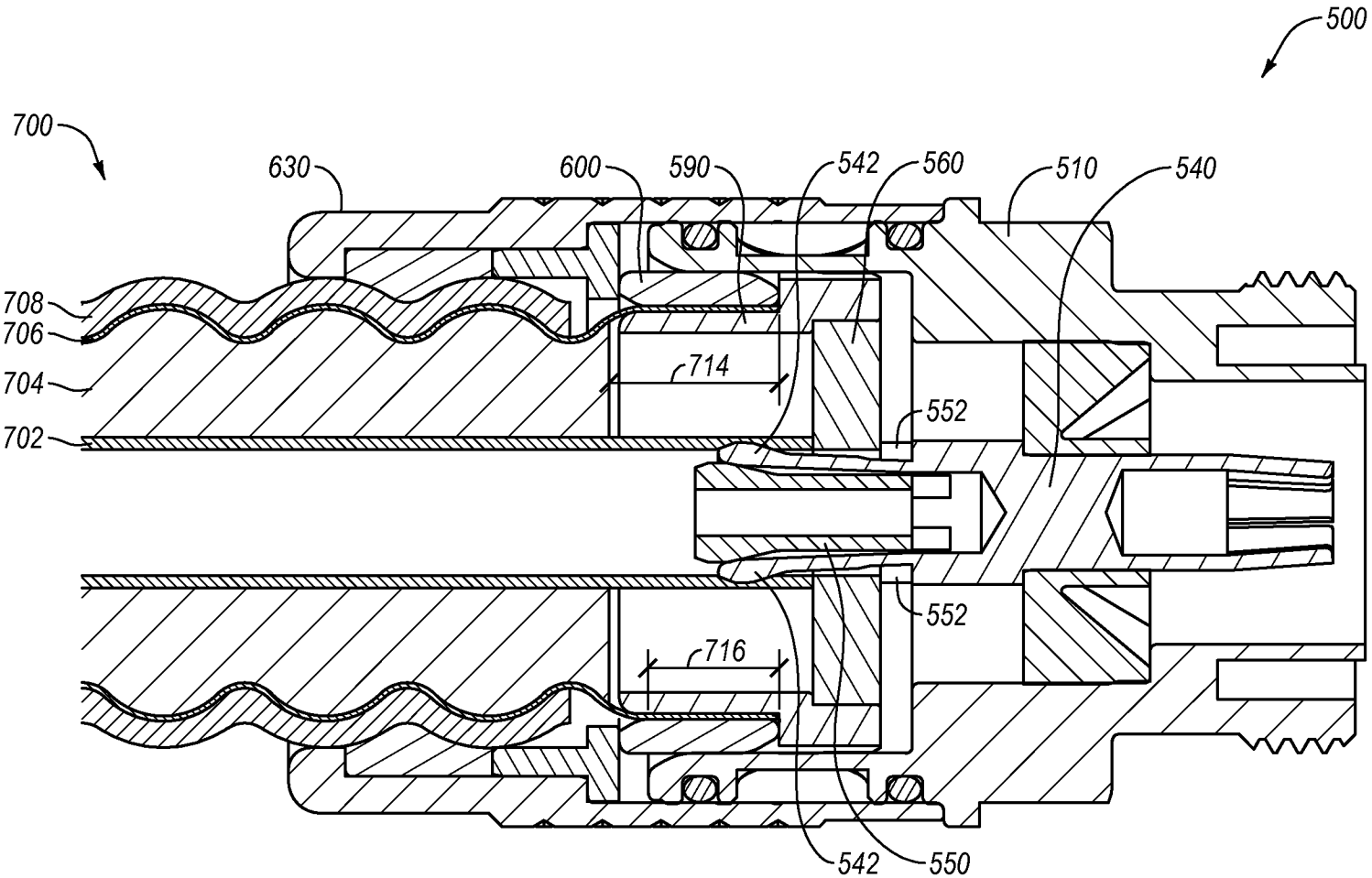
FIG. 7D is a cross-sectional side view of the example compression connector of FIG. 7A after having the terminal end of the example corrugated coaxial cable of FIG. 7C inserted into the example compression connector, with the example compression connector being in an engaged position.

With reference to FIGS. 3, 7C, and 7D, a third example embodiment of the method 400 in terminating an example coaxial cable 700 will now be disclosed. The acts 402-408 are first performed similarly to the first example embodiment of the method 400 disclosed above in connection with FIGS. 4A-4D. With reference to FIGS. 3 and 7C, the method 400 continues with the act 410 in which at least a portion of the internal connector structure 590 is inserted into the cored-out section 714 so as to be surrounded by the increased-diameter cylindrical section 716 of the outer conductor 706. Further, once inserted into the connector 500, the increased-diameter cylindrical section 716 is surrounded by the external connector structure 600. Also, once inserted into the connector 500, portions of the guide 550 and the conductive pin 540 can slide easily into the hollow inner conductor 702 of the coaxial cable 700.

With reference to FIGS. 3 and 7D, the method 400 continues with the act 412 in which the external connector structure 600 is clamped around the increased-diameter cylindrical section 716 so as to radially compress the increased-diameter cylindrical section 716 between the external connector structure 600 and the internal connector structure 590.

With reference to FIGS. 3 and 7D, the method 400 finishes with the act 414 in which the fingers 542 of the conductive pin 540 are radially expanded so as to increase a contact force between the inner conductor 702 and the fingers 542. For example, as disclosed in FIGS. 7C and 7D, as the compression connector 500 is moved into the engaged position, the conductive pin 540 is forced into the inner conductor 702 beyond the ramped portions 554 of the guide 550 due to the interaction of the tabs 552 and the insulator 560, which causes the conductive pin 540 to slide with respect to the guide 550. This sliding action forces the fingers 542 to radially expand due to the ramped portions 546 interacting with the ramped portion 554. This radial expansion of the conductive pin 540 results in an increased contact force between the conductive pin 540 and the inner conductor 702, and can also result in some deformation of the inner conductor 702, the guide 550, and/or the fingers 542. This expanding configuration increases the reliability of the mechanical and electrical contact between the conductive pin 540 and the inner conductor 702. The act 414 thus terminates the coaxial cable 700 by permanently affixing the connector 500 to the terminal end of the coaxial cable 700.

As noted above in connection with the first and second example embodiments of the method 400, the termination of the corrugated coaxial cable 700 using the example method 400 enables the impedance of the cored-out section 714 to remain about equal to the impedance of the remainder of the coaxial cable 700, thus reducing internal reflections and resulting signal loss associated with inconsistent impedance. Further, the termination of the corrugated coaxial cable 700 using the example method 400 enables improved mechanical and electrical contacts between the internal connector structure 590, the increased-diameter cylindrical section 716, and the external connector structure 600, as well as between the inner conductor 702 and the conductive pin 540, which reduces the PIM levels and associated creation of interfering RF signals that emanate from the example connector 500.

VIII. Alternative Embodiments of the Method for Terminating a Coaxial Cable

It is understood that two or more of the acts of the example method 400 discussed above can be performed via a single action or in reverse order. For example, a combination stripping and coring tool (not shown) can be employed to accomplish the acts 404 and 406 via a single action. Further, a combination coring and diameter-increasing tool (not shown) can be employed to accomplish the acts 406 and 408 via a single action. Also, the acts 402 and 404 can be performed via a single action using a stripping tool (not shown) that is configured to perform both acts. Further, the acts 404 and 406 can be performed in reverse order without materially affecting the results of the method 400.

The example embodiments disclosed herein may be embodied in other specific forms. The example embodiments disclosed herein are to be considered in all respects only as illustrative and not restrictive.

What is claimed is:

1. A method for terminating a coaxial cable, the coaxial cable comprising an inner conductor, an insulating layer surrounding the inner conductor, an outer conductor surrounding the insulating layer, and a jacket surrounding the outer conductor, the method comprising the following steps:

removing a section of the insulating layer between the outer conductor and the inner conductor so as to create a cored-out section therebetween;

increasing a diameter of at least a portion of the outer conductor that overlays a cored-out section of the insulating layer so as to create an increased-diameter cylindrical section of the outer conductor, the increased-diameter cylindrical section having a length that is at least two times a thickness of the outer conductor;

inserting at least a portion of an internal connector structure into the cored-out section so as to be surrounded by the increased-diameter cylindrical section;

inserting at least a portion of the inner conductor within a conductive pin resulting in an initial contact force between the inner conductor and the conductive pin; and via a single action:

clamping an external connector structure around the increased-diameter cylindrical section so as to radially compress the increased-diameter cylindrical section between the external connector structure and the internal connector structure; and increasing a contact force between the inner conductor and the conductive pin.

2. The method as recited in claim 1, wherein: the outer conductor comprises a corrugated outer conductor having peaks and valleys; and the step of increasing the diameter of at least a portion of the outer conductor that surrounds the cored-out section comprises the step of:

increasing a diameter of one or more of the valleys of the corrugated outer conductor that surround the cored-out section so as to create an increased-diameter cylindrical section of the corrugated outer conductor.

3. The method as recited in claim 2, wherein the increased-diameter cylindrical section of the corrugated outer conductor has a diameter that is greater than a diameter of the peaks of the corrugated outer conductor.

4. The method as recited in claim 2, wherein the increased-diameter cylindrical section of the outer conductor diameter has a diameter that is about equal to a diameter of unmodified peaks of the corrugated outer conductor.

5. The method as recited in claim 2, wherein the inserted portion of the internal connector structure comprises a metal inserted portion of the internal connector structure.

6. The method as recited in claim 5, wherein the thickness of the metal inserted portion of the internal connector structure is greater than the difference between an inside diameter of the peaks of the corrugated outer conductor and an inside diameter of the valleys of the corrugated outer conductor.

7. The method as recited in claim 5, wherein the metal inserted portion of the internal connector structure has an inside diameter that is about equal to an average diameter of the valleys and the peaks of the corrugated outer conductor.

8. The method as recited in claim 1, wherein the outer conductor comprises a smooth-wailed outer conductor having a substantially uniform diameter along the length of the outer conductor.

9. The method as recited in claim 8, wherein the inserted portion of the internal connector structure comprises a metal inserted portion of the internal connector structure.

10. The method as recited in claim 9, wherein the metal inserted portion of the internal connector structure has an inside diameter that is less than the substantially uniform inside diameter of the smooth-walled outer conductor.

11. The method as recited in claim 1, wherein the inserted portion of the internal connector structure comprises a cylindrical internal connector structure portion having a substantially uniform outside diameter along the length of the inserted portion of the internal connector structure.

* * * * *